US009353337B2

(12) United States Patent
Gonzales et al.

(10) Patent No.: US 9,353,337 B2
(45) Date of Patent: May 31, 2016

(54) LIQUID CLEANING COMPOSITION

(75) Inventors: Denis Alfred Gonzales, Brussels (BE); Eva Maria Perez-Prat Vinuesa, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 1265 days.

(21) Appl. No.: 13/236,683

(22) Filed: Sep. 20, 2011

(65) Prior Publication Data

US 2012/0071380 A1 Mar. 22, 2012

(30) Foreign Application Priority Data

Sep. 21, 2010 (EP) ..... 10177814
Sep. 21, 2010 (EP) ..... 10177815

(51) Int. Cl.

*C11D 3/382* (2006.01)
*C11D 3/40* (2006.01)
*C11D 17/00* (2006.01)
*C11D 17/04* (2006.01)

(52) U.S. Cl.

CPC *C11D 3/40* (2013.01); *C11D 3/382* (2013.01); *C11D 17/0013* (2013.01); *C11D 17/049* (2013.01)

(58) Field of Classification Search

USPC ..... 510/218
See application file for complete search history.

(56) References Cited

U.S. PATENT DOCUMENTS

| | | | |
|---|---|---|---|
| 1,621,906 | A | 3/1927 | Schloss |
| 2,082,275 | A | 6/1937 | Daimler et al. |
| 2,084,632 | A | 6/1937 | Ellis |
| 2,255,082 | A | 9/1941 | Orthner et al. |
| 2,438,091 | A | 3/1948 | Lynch |
| 2,528,378 | A | 10/1950 | Mannheimer |
| 2,658,072 | A | 11/1953 | Kosmin |
| 2,702,279 | A | 2/1955 | Funderburk et al. |
| 3,070,510 | A | 12/1962 | Cooley et al. |
| 3,586,715 | A | 6/1971 | Smeets |
| 3,812,044 | A | 5/1974 | Connor et al. |
| 3,915,903 | A | 10/1975 | Wise |
| 3,929,678 | A | 12/1975 | Laughlin et al. |
| 3,985,668 | A | 10/1976 | Hartman |
| 4,025,444 | A | 5/1977 | Murphy et al. |
| 4,051,056 | A | 9/1977 | Hartman |
| 4,088,620 | A | 5/1978 | Nihongi et al. |
| 4,102,992 | A | 7/1978 | Davis |
| 4,240,919 | A | 12/1980 | Chapman |
| 4,298,490 | A | 11/1981 | Lange et al. |
| 4,309,316 | A | 1/1982 | Lange et al. |
| 4,473,611 | A | 9/1984 | Haq |
| 4,481,126 | A | 11/1984 | Trinh et al. |
| 4,537,604 | A | 8/1985 | Dawson |
| 4,565,644 | A | 1/1986 | Smith et al. |
| 4,565,647 | A | 1/1986 | Llenado |
| 4,581,385 | A | 4/1986 | Smith et al. |
| 4,657,692 | A | 4/1987 | Choy et al. |
| 4,663,069 | A | 5/1987 | Llenado |
| 4,676,920 | A | 6/1987 | Culshaw |
| 4,704,233 | A | 11/1987 | Hartman et al. |
| 4,767,563 | A | 8/1988 | De Buzzaccarini |
| 4,772,425 | A | 9/1988 | Chirash et al. |
| 4,842,763 | A | 6/1989 | Troger et al. |
| 4,906,396 | A | 3/1990 | Falholt et al. |
| 5,287,207 | A | 2/1994 | Mulkens et al. |
| 5,500,451 | A | 3/1996 | Goldman et al. |
| 5,776,872 | A | 7/1998 | Giret et al. |
| 5,776,878 | A | 7/1998 | Thoen |
| 5,798,505 | A | 8/1998 | Lee |
| 5,821,214 | A | 10/1998 | Weibel |
| 5,830,445 | A | 11/1998 | Bouillon et al. |
| 5,883,062 | A | 3/1999 | Addison et al. |
| 5,898,026 | A | 4/1999 | Yianakopoulos et al. |
| 5,906,973 | A | 5/1999 | Ouzounis et al. |
| 6,008,181 | A | 12/1999 | Cripe et al. |
| 6,020,303 | A | 2/2000 | Cripe et al. |
| 6,060,443 | A | 5/2000 | Cripe et al. |
| 6,080,707 | A | 6/2000 | Glenn et al. |
| 6,132,212 | A | 10/2000 | Horiguchi et al. |
| 6,221,829 | B1 | 4/2001 | Symes et al. |
| 6,242,405 | B1 | 6/2001 | Lykke et al. |
| 6,265,363 | B1 | 7/2001 | Viscovitz |
| 6,268,325 | B1 | 7/2001 | Luciani et al. |
| 6,274,540 | B1 | 8/2001 | Scheibel et al. |
| 6,299,746 | B1 | 10/2001 | Conte et al. |
| 6,306,817 | B1 | 10/2001 | Kott et al. |
| 6,359,031 | B1 | 3/2002 | Lykke et al. |
| 6,369,121 | B1 | 4/2002 | Catalfamo et al. |
| 6,444,716 | B1 | 9/2002 | Hird et al. |
| 6,514,926 | B1 | 2/2003 | Kott et al. |
| 6,525,233 | B1 | 2/2003 | Connor et al. |

(Continued)

FOREIGN PATENT DOCUMENTS

| | | | | | |
|---|---|---|---|---|---|
| DE | 24 10 425 | A1 | | 10/1974 | |
| DE | 10 2004 038771 | A1 | | 8/2005 | |
| DE | 10 2005 023801 | A1 | | 11/2006 | |
| DE | WO.2009144139 | | * | 3/2009 | ..... A61K 8/25 |
| EP | 1 136 063 | A2 | | 9/2001 | |
| EP | 1136063 | A2 | | 9/2001 | |
| EP | 1 460 125 | A1 | | 9/2004 | |
| GB | 2 001 099 | A | | 1/1979 | |
| GB | 2 126 999 | A | | 4/1984 | |
| GB | 2 145 729 | A | | 4/1985 | |
| GB | 2145729 | A | | 4/1985 | |
| JP | 59192526 | A | | 10/1984 | |
| JP | A-S63-097697 | | | 4/1988 | |
| JP | A-H02-080497 | | | 3/1990 | |
| JP | 10025239 | A | | 1/1998 | |
| JP | A-2002-080894 | | | 3/2002 | |

(Continued)

OTHER PUBLICATIONS

U.S. Appl. No. 13/517,837, filed Jun. 14, 2012, Gonzales, et al.

(Continued)

*Primary Examiner* — Ling Choi
*Assistant Examiner* — Thuy-Al Nguyen
(74) *Attorney, Agent, or Firm* — Abbey A. Lopez

(57) ABSTRACT

The present invention relates to a liquid, cleaning composition comprising colored abrasive cleaning particles.

18 Claims, No Drawings

(56) References Cited

U.S. PATENT DOCUMENTS

| | | | |
|---|---|---|---|
| 6,537,957 | B1 | 3/2003 | Cardola et al. |
| 6,566,319 | B1 | 5/2003 | Scheibel et al. |
| 6,583,096 | B1 | 6/2003 | Kott et al. |
| 6,593,285 | B1 | 7/2003 | Scheibel et al. |
| 6,602,840 | B1 | 8/2003 | Scheibel et al. |
| 6,699,963 | B2 | 3/2004 | Noda et al. |
| 6,749,066 | B2 | 6/2004 | Bergman |
| 6,759,377 | B2 | 7/2004 | Hackenthal et al. |
| 6,767,878 | B1 | 7/2004 | Paye et al. |
| 6,808,759 | B1 | 10/2004 | Okumura et al. |
| 6,858,216 | B2 | 2/2005 | Schulze zur Wiesche et al. |
| 7,307,055 | B2 | 12/2007 | Cook et al. |
| 7,393,820 | B2 | 7/2008 | Soldanski et al. |
| 7,713,921 | B2 | 5/2010 | Boutique et al. |
| 7,994,111 | B2 | 8/2011 | Caggioni et al. |
| 2002/0137647 | A1 | 9/2002 | Hackenthal et al. |
| 2002/0166832 | A1 | 11/2002 | Silud et al. |
| 2002/0173243 | A1 | 11/2002 | Costas et al. |
| 2003/0176633 | A1 | 9/2003 | Noda et al. |
| 2003/0215417 | A1 | 11/2003 | Uchiyama et al. |
| 2004/0216388 | A1 | 11/2004 | Mathur et al. |
| 2004/0266645 | A1 | 12/2004 | Albrecht et al. |
| 2005/0065056 | A1 | 3/2005 | Cook et al. |
| 2005/0130873 | A1 | 6/2005 | Cheung et al. |
| 2005/0170979 | A1 | 8/2005 | Massaro et al. |
| 2005/0201965 | A1 | 9/2005 | Kuhlman et al. |
| 2006/0011885 | A1 | 1/2006 | Christmas et al. |
| 2006/0094635 | A1 | 5/2006 | Pereira |
| 2006/0177488 | A1 | 8/2006 | Caruso et al. |
| 2007/0006391 | A1 | 1/2007 | Ghosh et al. |
| 2007/0010415 | A1 | 1/2007 | Kinscherf et al. |
| 2007/0041927 | A1 | 2/2007 | Blaeser et al. |
| 2007/0043147 | A1 | 2/2007 | Higgins et al. |
| 2007/0135645 | A1 | 6/2007 | Ignatyev et al. |
| 2007/0138671 | A1 | 6/2007 | Anastasiou et al. |
| 2007/0167345 | A1 | 7/2007 | Soldanski et al. |
| 2007/0191256 | A1 | 8/2007 | Fossum et al. |
| 2007/0270730 | A1 | 11/2007 | Rische et al. |
| 2008/0108714 | A1 | 5/2008 | Swazey et al. |
| 2008/0139702 | A1 | 6/2008 | De Almeida et al. |
| 2008/0149137 | A1 | 6/2008 | Steinbrenner et al. |
| 2008/0248144 | A1 | 10/2008 | Guenter et al. |
| 2009/0176935 | A1 | 7/2009 | Boeckh et al. |
| 2009/0253816 | A1 | 10/2009 | Nascimento et al. |
| 2009/0291306 | A1 | 11/2009 | Quadbeck-Seeger |
| 2009/0325837 | A1 | 12/2009 | Mundschau et al. |
| 2010/0081604 | A1 | 4/2010 | Barger et al. |
| 2010/0081605 | A1 | 4/2010 | Barger et al. |
| 2010/0081606 | A1 | 4/2010 | Barger et al. |
| 2010/0197553 | A1 | 8/2010 | Barnabas et al. |
| 2011/0021398 | A1* | 1/2011 | Allef et al. ..... 510/138 |
| 2011/0039744 | A1 | 2/2011 | Heath et al. |
| 2011/0150787 | A1 | 6/2011 | Gonzales et al. |
| 2011/0150788 | A1 | 6/2011 | Gonzales et al. |
| 2011/0150949 | A1 | 6/2011 | Gonzales et al. |
| 2011/0150950 | A1 | 6/2011 | Gonzales et al. |
| 2011/0150951 | A1 | 6/2011 | Gonzales et al. |
| 2011/0178196 | A1 | 7/2011 | Steinke et al. |
| 2011/0189414 | A1 | 8/2011 | Whitehouse |
| 2011/0262371 | A1 | 10/2011 | Deleersnyder et al. |
| 2011/0262504 | A1 | 10/2011 | Deleersnyder et al. |
| 2011/0287105 | A1 | 11/2011 | Gittleman |
| 2012/0029519 | A1 | 2/2012 | Sengun et al. |
| 2012/0066851 | A1 | 3/2012 | Gonzales et al. |
| 2012/0071378 | A1 | 3/2012 | Gonzales et al. |
| 2012/0071379 | A1 | 3/2012 | Gonzales et al. |
| 2012/0071383 | A1 | 3/2012 | Perez-Prat Vinuesa et al. |
| 2012/0202730 | A1 | 8/2012 | Allef et al. |

FOREIGN PATENT DOCUMENTS

| | | | |
|---|---|---|---|
| JP | 2005 296822 | A | 10/2005 |
| JP | A-2005-314394 | | 11/2005 |
| JP | A-2006-070215 | | 3/2006 |
| JP | 2007 077311 | A | 3/2007 |
| JP | A-2008-081496 | | 4/2008 |
| JP | A-2008-239669 | | 10/2008 |
| JP | 2009 160717 | A | 7/2009 |
| WO | WO 91/14420 | A1 | 10/1991 |
| WO | WO 99/05084 | A1 | 2/1999 |
| WO | WO 99/52500 | A1 | 10/1999 |
| WO | WO 01/31110 | A1 | 5/2001 |
| WO | WO 02/38720 | A1 | 5/2002 |
| WO | WO 2004/071483 | A1 | 8/2004 |
| WO | WO 2008/109270 | A1 | 9/2008 |

OTHER PUBLICATIONS

U.S. Appl. No. 13/517,728, filed Jun. 14, 2012, Gonzales, et al.
U.S. Appl. No. 13/526,592, filed Jun. 19, 2012, Gonzales, et al.
U.S. Appl. No. 13/526,596, filed Jun. 19, 2012, Gonzales, et al.
U.S. Appl. No. 13/517,746, filed Jun. 14, 2012, Gonzales, et al.
U.S. Appl. No. 13/526,605, filed Jun. 19, 2012, Gonzales, et al.
U.S. Appl. No. 13/526,613, filed Jun. 19, 2012, Gonzales, et al.
U.S. Appl. No. 13/517,762, filed Jun. 14, 2012, Perez-Prat Vinuesa, et al.
U.S. Appl. No. 13/621,858, filed Sep. 18, 2012, Gonzales, et al.
U.S. Appl. No. 13/621,860, filed Sep. 18, 2012, Perez-Prat Vinuesa, et al.
PCT International Search Report, mailed Jan. 30, 2012 (13 pages).
EP International Search Report, mailes Jan. 30, 2012 (10 pages).
ASTM Designation: F1877-05 Jun. 10, 2009; Standard Practice for Characterization of Particles; 14 pages; chapter 11.3.6; Section 11.3.2.
International Standard; ISO 9276-6:2008(E) section 8.2; section 7; Representation of results of particle size analysis—Part 6: Descriptive and quantitative representation of particle shape and morphology.
"Vegetable Ivory", W.P. Armstrong, (http://waynesword.palomar.edu/pljan99.htm).
"Phytelephas", Wikipedia.org (http://en.wikipedia.org/wiki/Phytelephas).

* cited by examiner

LIQUID CLEANING COMPOSITION

TECHNICAL FIELD

The present invention relates to liquid compositions for cleaning a variety of inanimate surfaces, including hard surfaces in and around the house, dish surfaces, car and vehicles surfaces, etc. More specifically, the present invention relates to liquid scouring composition comprising suitable particles for cleaning and/or cleansing.

BACKGROUND OF THE INVENTION

Scouring compositions such as particulate compositions or liquid (incl. gel, paste-type) compositions containing abrasive components are well known in the art. Such compositions are used for cleaning a variety of surfaces; especially those surfaces that tend to become soiled with difficult to remove stains and soils.

Amongst the currently known scouring compositions, the most popular ones are based on abrasive particles with shapes varying from spherical to irregular. The most common abrasive particles are either inorganic like carbonate salt, clay, silica, silicate, shale ash, perlite and quartz sand or organic polymeric beads like polypropylene, PVC, melamine, urea, polyacrylate and derivatives, and come in the form of liquid composition having a creamy consistency with the abrasive particles suspended therein.

The surface safety profile of such currently known scouring compositions is inadequate alternatively, poor cleaning performances is shown for compositions with an adequate surface safety profile. Indeed, due to the presence of very hard abrasive particles, these compositions can damage, i.e., scratch, the surfaces onto which they have been applied. Indeed, the formulator needs to choose between good cleaning performance but featuring strong surface damage or compromising on the cleaning performance while featuring acceptable surface safety profile. In addition, such currently known scouring compositions at least in certain fields of application (e.g., hard surface cleaning) are perceived by consumers as outdated.

Abrasive particles derived from natural feedstock such as nut shell e.g.: shell from walnut, almond etc. or derived from seed stone e.g.: from olive, apricot, cherry, peach, etc. in certain degree fulfill above requirements but they are in nature of somewhat dark color or have undesired brown colour. Furthermore, their inclusion in an cleaning product yield an unaesthetic muddy-like liquid composition, which is highly undesirable by consumer/users as it compromise the appearance of the liquid composition and its cleaning performance. Therefore, there is a need to identify an abrasive particle derived from natural sources that fulfill equally the performance and the aesthetic requirements for cleaning/cleaning liquid composition.

These undesired effects can be overcome by using coloured abrasive particles, especially when the abrasive particles are derived from natural feedstock e.g.: from nut shell, seed stone, wood or more generally derived from plant materials.

The coloured particles can be either toned to match the colour of the liquid cleaning composition, or have a different (or contrasting) colour from the liquid cleaning composition colour.

It is thus an objective of the present invention to provide a liquid cleaning composition suitable to clean a variety of surfaces, including inanimate surfaces, such as hard surfaces in and around the house, dish surfaces, etc., wherein the composition provides good cleaning performance, whilst providing a good surface safety profile. It is also another objective of the present invention to provide aesthetically acceptable cleaning composition comprising abrasive cleaning particles to improve cleaning performance.

It has been found that the above objectives can be met by the composition according to the present invention.

It is an advantage of the compositions according to the present invention that they may be used to clean inanimate surfaces made of a variety of materials like glazed and non-glazed ceramic tiles, enamel, stainless steel, Inox®, Formica®, vinyl, no-wax vinyl, linoleum, melamine, glass, plastics, painted surfaces and the like.

A further advantage of the present invention is that in the compositions herein, the particles can be formulated at very low levels, whilst still providing the above benefits. Indeed, in general for other technologies, high levels of abrasive particles are needed to reach good cleaning performance, thus leading to high formulation and process cost, difficult rinse and end cleaning profiles, as well as limitation for aesthetics and a pleasant hand feel of the cleaning composition.

SUMMARY OF THE INVENTION

The present invention relates to a liquid cleaning composition comprising coloured cleaning particles as abrasives, wherein said coloured cleaning particles are selected from the group consisting of coloured nut shell particles, coloured stone particles, coloured particles derived from other plant parts, coloured wood particles and mixtures thereof, and wherein the liquid and the coloured cleaning particles have substantially same colour according to L*a*b* values based on CIELab colour measurement, wherein the difference between L*a*b* values of the liquid and the coloured abrasive particles, $\Delta L^*$ and $\Delta a^*$ and $\Delta b^*$ values are equal or below ±20.

Further, the present invention relates to a liquid cleaning composition comprising coloured cleaning particles as abrasives, wherein said coloured cleaning particles are selected from the group consisting of coloured nut shell particles, coloured stone particles, coloured particles derived from other plant parts, coloured wood particles and mixtures thereof, and wherein the liquid and the coloured cleaning particles have substantially different colour according to L*a*b* values based on CIELab colour measurement, the difference between L*a*b* values of the liquid and the coloured abrasive particles, $\Delta L^*$and/or $\Delta a^*$ and/or $\Delta b^*$ values are equal or above ±30.

The present invention further encompasses a process of cleaning a surface with a liquid, cleaning composition comprising coloured abrasive cleaning particles, wherein said surface is contacted with said composition, preferably wherein said composition is applied onto said surface.

DETAILED DESCRIPTION OF THE INVENTION

The Liquid Cleaning Composition

The compositions according to the present invention are designed as cleaners for a variety of inanimate surfaces.

In a preferred embodiment, the compositions herein are suitable for cleaning inanimate surfaces selected from the group consisting of household hard surfaces; dish surfaces; surfaces like leather or synthetic leather; and automotive vehicles surfaces.

By "household hard surface", it is meant herein any kind of surface typically found in and around houses like kitchens, bathrooms, e.g., floors, walls, tiles, windows, cupboards, sinks, showers, shower plastified curtains, wash basins, WCs, fixtures and fittings and the like made of different materials like ceramic, vinyl, no-wax vinyl, linoleum, melamine, glass, Inox®, Formica®, vitroceramic, any plastics, plastified wood, metal or any painted or varnished or sealed surface and the like. Household hard surfaces also include household appliances including, but not limited to refrigerators, freezers, washing machines, automatic dryers, ovens, microwave ovens, dishwashers and so on. Such hard surfaces may be found both in private households as well as in commercial, institutional and industrial environments.

By "dish surfaces" it is meant herein hard surfaces such as dishes, glasses, pots, pans, baking dishes and flatware made from ceramic, china, metal, glass, plastic (polyethylene, polypropylene, polystyrene, etc.), wood, enamel, Inox®, Teflon®, or any other material commonly used in the making of articles used for eating and/or cooking. Such dish surfaces may be found both in private households as well as in commercial, institutional and industrial environments.

The compositions according to the present invention are liquid compositions as opposed to a solid or a gas. Liquid compositions include compositions having a water-like viscosity as well as thickened compositions, such as gels and pastes.

In a preferred embodiment herein, the liquid compositions herein are aqueous compositions. Therefore, they may comprise from 30% to 99.5% by weight of the total composition of water, preferably from 35% to 98% and more preferably from 40% to 95%.

In another preferred embodiment herein, the liquid compositions herein are mostly non-aqueous compositions although they may comprise from 0% to 10% by weight of the total composition of water, preferably from 0% to 5%, more preferably from 0% to 1% and most preferably 0% by weight of the total composition of water.

In a preferred embodiment herein, the compositions herein are neutral compositions, and thus have a pH, as is measured at 25° C., of 6-10, more preferably 6.5-9.5, even more preferably 7-9.

In other preferred embodiment compositions have pH preferably above pH 4 and alternatively have pH preferably below pH 9.5.

Accordingly, the compositions herein may comprise suitable bases and acids to adjust the pH.

A suitable base to be used herein is an organic and/or inorganic base. Suitable bases for use herein are the caustic alkalis, such as sodium hydroxide, potassium hydroxide and/or lithium hydroxide, and/or the alkali metal oxides such, as sodium and/or potassium oxide or mixtures thereof. A preferred base is a caustic alkali, more preferably sodium hydroxide and/or potassium hydroxide.

Other suitable bases include ammonia, ammonium carbonate, all available carbonate salts such as $K_2CO_3$, $Na_2CO_3$, $CaCO_3$, $MgCO_3$, etc., alkanolamines (as e.g. monoethanolamine), urea and urea derivatives, polyamine, etc.

Typical levels of such bases, when present, are of from 0.01% to 5.0%, preferably from 0.05% to 3.0% and more preferably from 0.1% to 0.6% by weight of the total composition.

The compositions herein may comprise an acid to trim its pH to the required level, despite the presence of an acid, if any, the compositions herein will maintain their neutral to alkaline, preferably alkaline, pH as described herein above. A suitable acid for use herein is an organic and/or an inorganic acid. A preferred organic acid for use herein has a pKa of less than 6. A suitable organic acid is selected from the group consisting of citric acid, lactic acid, glycolic acid, succinic acid, glutaric acid and adipic acid and a mixture thereof. A mixture of said acids may be commercially available from BASF under the trade name Sokalan® DCS. A suitable inorganic acid is selected from the group consisting hydrochloric acid, sulphuric acid, phosphoric acid and a mixture thereof.

A typical level of such an acid, when present, is of from 0.01% to 5.0%, preferably from 0.04% to 3.0% and more preferably from 0.05% to 1.5% by weight of the total composition.

In a preferred embodiment according to the present invention the compositions herein are thickened compositions. Preferably, the liquid compositions herein have a viscosity of up to 7500 cps at 20 $s^{-1}$, more preferably from 5000 cps to 50 cps, yet more preferably from 2000 cps to 50 cps and most preferably from 1500 cps to 300 cps at 20 $s^{-1}$ and 20° C. when measured with a Rheometer, model AR 1000 (Supplied by TA Instruments) with a 4 cm conic spindle in stainless steel, 2° angle (linear increment from 0.1 to 100 $sec^{-1}$ in max. 8 minutes).

In another preferred embodiment according to the present invention the compositions herein have a water-like viscosity. By "water-like viscosity" it is meant herein a viscosity that is close to that of water. Preferably the liquid compositions herein have a viscosity of up to 50 cps at 60 rpm, more preferably from 0 cps to 30 cps, yet more preferably from 0 cps to 20 cps and most preferably from 0 cps to 10 cps at 60 rpm and 20° C. when measured with a Brookfield digital viscometer model DV II, with spindle 2.

Abrasive Cleaning Particles

The liquid cleaning composition herein comprise abrasive cleaning particles formed by shearing and/or grinding nut shell, stones, or other plant parts such as, but not limited to, stems, roots, leaves, seeds, fruits, and mixtures thereof. Wood can also be used to produce the abrasive cleaning particles of the present composition.

Preferably nut shell is selected from the group consisting of pistachio nut shell, walnut shell, almond shell, hazelnut shell, macadamia nut shell, pine nut shell and mixtures thereof. Preferably nut shell is pistachio nut shell or walnut shell.

When pits or other plant parts are used to produce the cleaning particles for the present composition, they are preferably derived from rice, corn cob, palm biomass, bamboo, kenaf, apple seeds, apricot stone, peach stone, cherry stone, Tagua palm (*Phyleteas* genus) seed, Doum palm (*Hyphaene* genus) seed, Sago palm (*Metroxylon* genus) seed, olive stone, and mixtures thereof. When pits or other plant parts are used, olive stone is preferred.

The abrasive particles used herein are preferably coloured. Various well-known colouring processes may be used e.g.: via the use of dye or pigment. Most commonly colouring dye or pigment is deposited on to the surface of the particle (direct process). Alternatively, when the natural particle is naturally porous or rendered porous with artificial means (such as acidic treatment), the dye or pigment is also colouring the core of the abrasive particle. Nonetheless, the natural abrasive particles are dyed or pigmented after the raw natural material has been reduced into the final particle size in order to maintain the intended colour.

Most preferably the natural abrasive particles are coloured with dyes. Suitable dyes are either natural or synthetic (*The Dictionary of Coal Tar Colours*, by George H. Hurst for synthetic dyes or more generally *The Chemistry of Organic Colouring Matters*, by Nietzki). The used dyes and dying processes are selected based on their ability to effectively colour natural based particles, wherein the particles contain a substantial amount of cellulose, lignocelluloses and more generally carbohydrates-derived structures.

Preferred dyes according to the present invention are derived from the groups of Azo, Benzo, Chicago, Columbia, Congo, Di or triamine, Paramine, Dianil, Mikado, Oxydiamine, Titan, Zambessi and mixtures thereof.

Suitable dying processes to be used in the present invention are direct-, acidic-, basic- and mordant-dyeing processes. These processes are particularly preferred due their simplicity and versatility. Most preferably direct dyeing processes are used.

In direct dying process the dye or mixture of dyes is mixed directly with the natural abrasive particles in an aqueous media. Dyes are used alone or with a fixing salt selected from the group consisting of metal carbonate and/or metal bicarbonate and/or sodium hydroxide and/or phosphate salt and/or borax salt and/or sodium sulfate salt and/or acetic acid. Fixing salt will improve the dying process. Reaction mixture is preferably boiled for at least 1 hour to achieve faster and more resilient dying results.

Optionally, in order to minimize dye fastening phenomenon, e.g.: dye leaching during the ageing or the use of the liquid cleaning composition, the direct dyes can be mixed with salts and/or metallic salts e.g.; zinc salt e.g.: zinc sulphate or chromium salt, e.g.: chromium fluoride or iron e.g.: iron sulfate, zirconium salts, aluminium salt or copper salt e.g.: copper sulfate. Additionally, the direct dyes can also be mixed with organic coupling agent by diazotization using Nitrazol C, Azophor red P N, Azophor blue P N.

Alternatively, direct dying process can be made in situ, wherein direct dyes and associated fixing salt are added into the liquid cleaning composition so that the natural abrasive cleaning particles are dyed in situ during the making and/or the storage of the liquid composition.

Suitable direct dyes used in the present invention are for example Atlas red R, Azo Blue, Azo mauve A M, Azo violet, Benzo azurine 3 R, Benzo azurine G, Benzo blue 3 B, Benzo brown, Benzo brown G, Benzo brown N B, Benzo chrome black blue B, Benzo fast grey, Benzo green B B, Benzo green G, Benzo olive, Benzo orange, Benzo orange R, Benzo purpurine, Benzo purpurine 4 B, Brilliant azurine 5 G, Brilliant orange G, Brilliant purpurine R, Chicago blue 4 R, Chicago blue 6 B, Chlorophenine orange R, Chrysamine, Chrysamine G, Chrysamine R, Chrysophenine, Columbia black F B, Columbia Black F B B, Columbia green, Columbia orange R, Columbia yellow, Congo blue 2 B, Congo Corinth B, Congo Corinth G, Congo orange R, Congo rubine, Congo Red, Cotton brown N, Cotton yellow, Cross dye drab, Curcumine S, Curcuphenine, Diamine black B, Diamine black B H, Diamine black B 0, Diamine black H W, Diamine black R O, Diamine blue 3 B, Diamine blue 3 R, Diamine blue B G, Diamine blue B X, Diamine blue black E, Diamine blue black R, Diamine blue R W, Diamine Bordeaux B, Diamine brilliant blue G, Diamine bronze, Diamine bronze G, Diamine brown, Diamine brown G, Diamine brown M, Diamine brown V, Diamine catechine B, Diamine catechine G, Diamine dark green N, Diamine deep black Cr, Diamine deep black R B, Diamine deep blue R, Diamine fast red F, Diamine fast yellow, Diamine fast yellow A, Diamine fast yellow B, Diamine fast yellow R, Diamine gold, Diamine green B, Diamine green G, Diamine jet black Cr, Diamine jet black R B, Diamine new blue R, Diamine orange B, Diamine Orange G, Diamine orange G D, Diamine red 10 B, Diamine red 5 B, Diamine red N, Diamine rose B D, Diamine rose G D, Diamine scarlet 3 B, Diamine scarlet B, Diamine sky blue, Diamine sky blue F F, Diamine steel blue L, Diamine violet N, Diamine yellow, Diamine yellow N, Diamineral blue R, Dianil black C R, Dianil blue, Dianil blue 2 R, Dianil blue 4 R, Dianil blue B, Dianil blue G, Dianil brown 3 G O, Dianil brown B D, Dianil brown G, Dianil brown R, Dianil brown T, Dianil claret B, Dianil claret G, Dianil dark blue 3 R, Dianil dark blue R, Dianil dark brown, Dianil olive, Dianil orange 2 R, Dianil orange G, Dianil red 4 B, Dianil yellow 2 R, Dianil yellow 3 G, Dianil yellow G, Dianil yellow R, Diphenyl brown B N, Direct deep black E, Direct indigo blue, Direct triamine black G X, Direct yellow G, Direct yellow R, Erie blue B X, Erika B N, Heliotrope 2 B, Heliotrope B B, Hessian brown 2 B N, Hessian brown 2 M, Mikado brown M, Mikado orange 4 R, Mikado orange G, Neutral grey G, Oxydiamine black A, Oxydiamine black N, Oxydiamine black N R, Oxydiamine orange G, Oxydiamine orange R, Oxydiamine violet B, Oxydiamine violet G, Oxydiamine yellow G G, Oxyphenine, Paramine blue B, Paramine blue black S, Paramine brown G, Paramine indigo blue, Paramine navy blue R, Pluto black B, Rose azurine G, Rosophenine 5 B, Sulphon azurine D, Sun yellow, Thiazole yellow, Thioflavine S, Titan blue 3 B, Titan blue R, Titan brown R, Titan brown Y, Titan como G, Titan como S N, Titan gold, Titan navy R, Titan orange, Titan orange N, Titan scarlet C, Titan scarlet D, Titan yellow G G, Titan yellow Y, Toluylene orange G, Toluylene orange R, Triamine black B, Triamine black B T, Zambesi black B R, Zambesi black D.

Basic dying process using basic dyes can also be used in the present invention, however, this is less preferred process compared to the direct dying process. When basic dyes are used they are preferably used with coupling agents to improve the dying result. In this case the natural abrasive particles are preferably pre-treated with mordants material e.g.: by using tannic acid as mordant with or without fixing salts such as tartaric acid, tartar emetic, tin crystals, copperas and antimony salts e.g.: antimony fluoride. Typically, the dying process is done in 3 steps. In first step particles are washed with Tannic acid solution, followed by optional step 2: wash with fixing salt solution and final step 3: wherein the abrasive particles are contacted with basic dye or dye solution, optionally boiled for at least 1 hr. Most preferably basic dyes are used with tannic acid.

Alternatively the basic dyes are used as topping dyes to the direct dye e.g.: as being post-added onto the abrasive particles dyed by direct dyes/processes. Purpose of the topping dye is to use it to achieve certain color shade, which is not easily achieved solely with direct dying process. Additionally the toping of direct dyes with basic dyes improve the stability of dyes.

Examples of suitable basic dyes which can be used to top direct dyes are: Bismarck brown, Brilliant green, Methyl violet B, Methyl violet 2 B, Methyl violet R, Methyl violet 3 R, New Victoria blue B, New Methylene blue N, New Methylene blue 3 R, Safranine, Malachite green, Safranine G, Tannin heliotrope, Turquoise blue G, Turquoise blue B B.

Examples of suitable basic dyes to be used in basic dying process are Auramine G, Auramine I I, Bismarck brown, Bismarck brown, Brilliant green, Brilliant rhoduline red B, Chrysoidine, Fast neutral violet B, Indamine blue N, Irisamine G, Magenta, Malachite green, Metaphenylene blue B, Methyl violet 2 B, Methyl violet 3 R, Methyl violet 4 R, Methyl violet B, Methyl violet R, Methylene blue 2 B, Methylene blue B B, Methylene grey B F, Naphtindone B B, New Methylene blue 3 R, New Methylene blue 3 R, New Methylene blue G G, New Methylene blue N X, New Methylene blue N, New Methylene blue R, New Methylene grey B, New Methylene grey G, New Phosphine G, New Victoria blue B, Rhodamine 6 G, Rhodamine B, Rhodamine G, Rhoduline viole, Safranine G, Safranine prima, Safranine S, Safranine, Tannin heliotrope, Tannin orange R, Thioflavine T, Turquoise blue B B, Turquoise blue G and Victoria blue B. etc.

Alternatively, Janus basic dyes can be used in the basic dying process with or without acid selected from the group consisting of sulphuric acid, tannic acid, tartar derivative or mixtures thereof. Examples of suitable Janus dyes are Janus blue G, Janus green B, Janus blue R, Janus yellow R, Janus red B, Janus claret red B, Janus yellow R, Janus grey B and Janus brown B. Most preferably Janus dyes are used with sulphuric acid.

Mordant dying process can also be used in the present invention, however, this is less preferred process compared to the direct dying process. Suitable Mordant dyes to be used in the present invention are alizarine, logwood, fustic, barwood, cutch, resorcine green, Persian berries, Brazil wood, camwood, cochineal, quercitron and cutch, which all can be combined with metallic oxide such as iron, chromium, aluminum, tin, lead and calcium.

The metal oxide e.g.: metallic mordant is fixed on the particles by any suitable method. Typically, the particles can be pre-treated with metal salt such as stannate, lead, and aluminium and followed by the addition of the metal oxide (optionally in acidic condition, e.g.: using tannic, sulfuric, etc.) and subsequently followed by addition of the dye or mixture of dyes. Eosine dyes in particular and some members of the azo dyes, particularly the croceine scarlets are preferred, since the final color grade is not affected by the choice of the metal oxide.

Alternatively, mordant dyes such as logwood, fustic, madder, alizarine, and all the dyes derived from anthracene can also be used, but the final color grades are impacted by the used metal oxide. For example logwood produce blue color when used with chrome oxide, or reddish blue with alumina oxide, while Alizarine produces dark violet with iron oxide, scarlet with alumina oxide, red chrome oxide and bright scarlet with tin oxide. Fustic provides bright yellow with tin and alumina oxide, dark yellow with chrome oxide and olive with iron oxide, etc.

Alternatively, VAT dying process can be used in the present invention, however, this is less preferred process compared to the direct dying process. In the VAT dying process the water insoluble dyes are used. Vat dyes are preferred to help to maintain the stability of the coloured particles while formulated in the liquid cleaning composition. Water insoluble Vat dyes are typically in reduced form (reduction can be done by any known chemical means). Some dyes are available commercially in their reduced forms either in solution or in suspensions. The VAT dyes are contacted with the abrasive particles then the dye-contacted abrasive particles undergo an oxidation process to restore in-situ the oxidized, substantially insoluble, form of the VAT dye.

Suitable VAT dyes to be used in the present invention are structures derived from quinonic structure, anthraquinones or indigoids. Non exhaustive list of Vat dyes are indigo, and the artificial dyes under the indanthrene or flavanthrene trade names.

In yet another embodiment, the dye is a polymeric dye. The polymeric dyes are composed from optically chromophoric groups which are bound to or into polymers. They are classified as block type and graft type polymers according to their structures. Both block polymeric dyes and graft polymeric dyes offer the advantages with their variable and amendable physical properties ranges, such as solubility, absorption, migration and viscosity.

Polymeric water-soluble dyes comprising water-insoluble chromophores can also be used to dye the abrasive particles of the present invention. Preferred polymeric dyes have pendent chromophore groups which are selected from azo, tricyanovinyl, anthraquinone, methine, and indoaniline groups.

Alternatively, the natural abrasive particles can be colored via use of pigment and pigmenting process or technology. Usually, good coloring results are achieved by promoting the deposition of the pigment onto the surface of the natural particle so to create a rather continuous layer of pigmented material.

The efficiency of the deposition process can be increased by embedding the colouring pigment in a carrier whereas the carrier is a resin, polymer, waxes, etc. and mixture thereof. The colouring process by using colouring pigment and carrier mix can be achieved via solvent or emulsion, followed by evaporation or precipitation, melt, or layer-by-layer deposition by using electrolyte polymer eg.: via successive additions of aqueous solution of positively charged polymer e.g.: poly (diallyldimethylammonium chloride) and polystyrene sulfonate with or without the presence of pigment in the polyelectrolyte solution. Process using spray-colouring are particularly preferred to achieve thin coating of individual particles.

Suitable pigments can be natural or synthetic. Preferred pigments are inorganic minerals or from organic origin. In one embodiment of the present invention, the pigment is in powdered form, wherein the particle size of the pigment powder is below 50 μm, more preferably below 10 μm, even more preferable below 5 μm and most preferably below 1 μm. Preferred pigments are chemically inert and stable to UV, however, fugitive pigment can also be used.

In one embodiment of the present invention, the natural pigment is derived from the mica. In yet another embodiment of the present invention, pigments from unusual sources such as botanical materials, animal waste, insects, and mollusks can be used.

In accordance with another embodiment of the present invention, the pigment may be from inorganic minerals. Preferred inorganic pigments are the FDA approved pigment such as Blue 29 ultramarine, white 6 titanium oxide and white 18 calcium carbonate. Preferred organic pigments are FDA approved pigments with non-exhaustive examples such as blue 15 phthalocyanine and red 38 pyrazolone. In one embodiment of the present invention, inorganic food grade pigments such as E180, E171 and E172 and organic food grade pigment such as turmeric pigment may be used.

Preferably the thickness of the colouring material layer of the nut shell and/or vegetable particles is from 1 μm to 40 μm, preferably from 1 μm to 20 μm, more preferably from 1 μm 10 μm. The thickness of the colouring layer is measured from sliced material by scanning electron microscopy.

In one embodiment of the present invention the coloured abrasive cleaning particles are the same colour than the liquid phase of the liquid cleaning composition.

Yet in another embodiment of the present invention the coloured abrasive cleaning particles are different colour than the liquid phase of the liquid cleaning composition.

Yet in another embodiment of the present invention the coloured abrasive cleaning particles are mixture of the same colour and different colour than the liquid phase of the cleaning composition.

The colour of the particles and of the liquid phase of the liquid cleaning composition are measured according to the CIELAB colour scale (L*, a*, b*), which is based on the opponent-colours theory, which assumes that the receptors in the human eye perceive colour as the following opposites: light-dark; red-green; yellow-blue. The L*value indicates the level of light or dark, the a* value indicates redness or greenness and the b*value indicates yellowness or blueness. All three values are required to completely describe an object's colour.

The difference between L*a*b* values of liquid and abrasive particles are indicated by ΔL* and Δa* and Δb* values.

ΔL* is the difference between the L* value of colored particle and the L* value of liquid phase of the liquid cleaning composition, and Δa* is the difference between the a* value of colored particle and the a* value of liquid phase of the liquid cleaning composition, and Δb* is the difference between the b* value of colored particle and the b* value of liquid phase of the liquid cleaning composition, on both positive and negative scales respectively.

When the coloured particles and the liquid phase of the liquid cleaning composition have substantially same colours according to L*a*b* values based on CIELab colour measurement, the difference between L*a*b* values of the abrasive particles and the liquid phase of the liquid composition, ΔL* and Δa* and Δb* values are equal or below ±20, preferably equal or below ±10 and most preferably equal or below ±5. By the term "substantially same colours" is meant by colours which are the same or very close to the same colour, having only substantial difference in ΔL* and Δa* and Δb* values (equal or below ±20).

For example if the a* value of the liquid phase of the cleaning composition is −30, Δa* value is equal or below ±20, preferably equal or below +10 and most preferably equal or below ±5, therefore, the a* value of the particles can be between −50 and −10, preferably between −40 and −20 and more preferably between −35 and −25. Similarly if the a* value of the coloured particles is 40, Δa* value is equal or below ±20, preferably equal or below ±10 and most preferably equal or below ±5, and therefore, the a* value of the liquid phase can be between 60 and 20, preferably 50 and 30 and more preferably between 45 and 35. Identical criteria is applied to ΔL* and Δb*.

When the coloured particles and the liquid phase of the liquid cleaning composition have different colours according to L*a*b* values based on CIELab colour measurement, the difference between L*a*b* values of and the abrasive particles and the liquid phase of the liquid composition, ΔL*and/or Δa* and/or Δb* values are equal or above ±30, preferably equal or above ±40 and most preferably equal or above ±50. By the term "substantially different colours" is meant by colours which are different or very different colours, having substantial difference in ΔL* and Δa* and Δb* values (equal or above ±30).

Measuring the Color of Cleaning Products and Natural Particles

The color of the cleaning compositions should be defined in CIELab colour space coordinates which have been calculated from measurements made with a dual-beam spectrophotometer, with 1 cm optical path length. Measurements are done following the instrument manufacturer instructions. More detailed information on the CIELab calculations are available in Color for Science, Art and Technology. K. Nassau Editor. 1998. Elsevier Science B.V. Chapter 2, The Measurement of Color. R.T. Marcus.

The following instrument settings should be used to acquire the spectral measurements of a isotropic, non-opacified hand dish cleaning liquid composition:

Scale CIELab L*, a*, b*, wherein L* is the lightness/darkness, a* is the greenness/redness and b* is the yellowness/blueness of the sample.

Illuminant D65

Observer 10°

Mode Transmission

UV filter 410 nm-In 1 cm optical path length sample cuvette made of optical glass A standardized white-reference ceramic tile from (Hunter Lab) is used with the reference beam reflected port.

An example of a suitable instrument is the UltraScan XE from Hunter Associates Laboratory Inc which uses a white-lined diffuse integrated sphere to project light at the sample. The sample spectrum is collected by the instrument and then software, for example the Universal software package from Hunter Associates Laboratory Inc., converts the spectral data into CIELab L*, a*, b* values. For example, to measure the color of isotropic and non-opacified hand dish cleaning liquid compositions 1 cm path length sample cuvette is filled with the amount of product needed to completely cover the measuring port and placed in front of the transmission port of a calibrated spectophotometer. A standardized white-reference ceramic tile from Hunter Lab is placed in front of the reflectance port, the Illuminant, observer, mode, scale, and UV filter conditions are selected as indicated above, then the spectral data is collected and the L*, a*, b* values are obtained.

The color of the coloured natural particles should be measured with a hand held spectrophotometer, to provide the L*, a*, b* values of the particle sample according to the CIELab color scale. An example of a suitable instrument is a BYK spectro-guide 45/0 gloss from BYK Additives & Instruments, an optical glass sample plate and/or optical glass sample cup (accessory numbers CC-6135 and CC-6136) completely filled with particles should be used following manufacturer instructions and settings for the measurement of granular/powdered materials.

EXAMPLES

| Product/particle | Colour of product/particle | L* value of product/particle | a* value of product/particle | b* value of product/particle |
|---|---|---|---|---|
| Hand dish/green coloured olive stone | Dark green/dark green | 66.90/37.65 | −59.54/−26.32 | 36.10/14.02 |
| Hand dish/red coloured wood fibers | Red/dark red | 57.21/39.47 | 49.21/43.32 | 20.28/23.99 |
| Hand dish/blue coloured olive stone | Blue/dark blue | 75.16/26.85 | −38.40/−14.00 | −28.49/−15.55 |
| Hand dish/ yellow coloured wood fibres | Yellow/yellow | 94.97/73.74 | −14.13/3.29 | 47.27/64.23 |
| Hand dish | Orange | 87.84 | −1.62 | 42.19 |
| Hand dish | Dark purple | 66.82 | 37.99 | −17.71 |
| Hand dish | Pink | 91.29 | 9.16 | 6.1 |

It has surprisingly been found that the abrasive cleaning particles of the present invention show a good cleaning performance even at relatively low levels, such as preferably 0.5%, to 20%, preferably from 1% to 10%, more preferably from 2% to 8% and most preferably from 3% to 6% by weight of the composition.

In a preferred embodiment the abrasive cleaning particles are preferably non-rolling. Alternatively in another preferred embodiment the abrasive cleaning particles are preferably sharp. By non-rolling is meant that the abrasive cleaning particle and the surface are in contact with each other by sliding.

Indeed the applicant has found that non-rolling and/or sharp abrasive cleaning particles provide good soil removal.

In a preferred embodiment, the abrasive cleaning particles have a mean ECD from 10 μm to 1000 μm, preferably from 50 μm to 500 μm, more preferably from 100 μm to 350 μm and most preferably from 150 to 250 μm.

The abrasive particle size is also critical to achieve efficient cleaning performance whereas excessively abrasive population with small particle sizes e.g.: typically below 10 micrometers feature polishing action vs. cleaning despite featuring a high number of particles per particle load in cleaner inherent to the small particle size. On the other hand, abrasive population with excessively high particle size, e.g.: above 1000 micrometers, do not deliver optimal cleaning efficiency, because the number of particles per particle load in cleaner, decreases significantly inherently to the large particle size. Additionally, excessively small particle size are not desirable in cleaner/for cleaning task since in practice, small and numerous particles are often hard to remove from the various surface topologies which requires excessive effort to remove from the user unless leaving the surface with visible particles residue. On the other hand, excessively large particle are too easily detected visually or provide bad tactile experience while handling or using the cleaner. Therefore, the applicants define herein an optimal particle size range that delivers both optimal cleaning performance and usage experience.

The abrasive particles have size defined by their area-equivalent diameter (ISO 9276-6:2008(E) section 7) also called Equivalent Circle Diameter ECD (ASTM F1877-05 Section 11.3.2). Mean ECD of particle population is calculated as the average of respective ECD of each particles of a particle population of at least 10,000 particles, preferably above 50,000 particles, more preferably above 100,000 particles after excluding from the measurement and calculation the data of particles having area-equivalent diameter (ECD) of below 10 μm. Mean data are extracted from volume-based vs. number-based measurements.

In one preferred example, the size of the abrasive cleaning particles used in the present invention is altered during usage especially undergoing significant size reduction. Hence the particle remain visible or tactile detectable in liquid composition and in the beginning of the usage process to provide effective cleaning. As the cleaning process progresses, the abrasive particles disperse or break into smaller particles and become invisible to an eye or tactile undetectable.

One suitable way of reducing the nut shell and/or the pits and/or plant parts to the abrasive cleaning particles herein is to grind or mill nut shell and/or other plant parts. Other suitable means include the use of eroding tools such as a high speed eroding wheel with dust collector wherein the surface of the wheel is engraved with a pattern or is coated with abrasive sandpaper or the like to promote the nut shell and/or the pits and/or other plant parts to form the abrasive cleaning particles herein.

Alternatively the bulk nut shell and/or pits and/or plant parts can be broken into pieces of a few cm dimensions by manually chopping or cutting, or using a mechanical tool such as a lumpbreaker, for example the Model 2036 from S Howes, Inc. of Silver Creek, N.Y. In a second stage, the lumps are agitated using a propeller or saw toothed disc dispersing tool, which causes the nut shell and/or pits and/or plant parts to release entrapped water and form liquid slurry of nut shell and/or vegetables particles dispersed in aqueous phase. In a third stage, a high shear mixer (such as the Ultra Turrax rotor stator mixer from IKA Works, Inc., Wilmington, N.C.) can be employed to reduce the particle size of the primary slurry to that required for cleaning particles. Preferably the abrasive cleaning particles obtained via grinding or milling operation are single particles.

Preferred abrasive cleaning particles in the present invention have hardness from 40 to 90, preferably from 60 to 90, more preferably from 50 to 85 and most preferably from 70 to 80 before undergoing the coloring treatment or before being immersed in the liquid cleaning composition, measured according to Shore D hardness scale. The hardness Shore D is measured with a durometer type D according to a procedure described in ASTM D2240.

Alternatively the preferred abrasive cleaning particles in the present invention have hardness from 0.2 to 3, preferably from 0.2 to 2 when immersed in the liquid cleaning composition, measured according to MOHS hardness scale. The MOHS hardness scale is an internationally recognized scale for measuring the hardness of a compound versus a compound of known hardness, see Encyclopedia of Chemical Technology, Kirk-Othmer, $4^{th}$ Edition Vol 1, page 18 or Lide, D. R (ed) CRC Handbook of Chemistry and Physics, 73 rd edition, Boca Raton, Fla.: The Rubber Company, 1992-1993.

By "hardness of the cleaning particles" herein it is meant hardness of the core material of the abrasive material. Coating/coloring material does not have impact on overall hardness.

The abrasive cleaning particles used in the present invention can be a mixture of coloured nut shell particles or colored particles from pits or coloured particles derived from other plant parts and other suitable abrasive cleaning particles. However, all other abrasive cleaning particles need to have Shore D hardness scale below or equal to 90 or MOHS hardness below 3. The other abrasive cleaning particles can be selected from the group consisting of plastics, hard waxes, inorganic and organic abrasives, and natural materials. The other abrasive cleaning particle is substantially insoluble or partially soluble in water. Most preferably the abrasive component is calcium carbonate or derived from natural vegetable abrasives. Additionally, the color of the other abrasive particles need to be compatible with the delta L*, a*, b* requirement of the present invention.

Optional Ingredients

The compositions according to the present invention may comprise a variety of optional ingredients depending on the technical benefit aimed for and the surface treated.

Suitable optional ingredients for use herein include suspending aids, chelating agents, surfactants, radical scavengers, perfumes, surface-modifying polymers, solvents, builders, buffers, bactericides, preservatives, hydrotropes, colourants, stabilizers, bleaches, bleach activators, suds controlling agents like fatty acids, enzymes, soil suspenders, brighteners, anti dusting agents, dispersants, pigments, and dyes.

Suspending Aid

The abrasive cleaning particles present in the composition herein are solid particles in a liquid composition. Said abrasive cleaning particles may be suspended in the liquid composition. However, it is well within the scope of the present invention that such abrasive cleaning particles are not-stably suspended within the composition and either settle or float on top of the composition. In this case, a user may have to temporally suspend the abrasive cleaning particles by agitating (e.g., shaking or stirring) the composition prior to use.

However, it is preferred herein that the abrasive cleaning particles are stably suspended in the liquid compositions herein. Thus the compositions herein comprise a suspending aid.

The suspending aid herein may either be a compound specifically chosen to provide a suspension of the abrasive cleaning particles in the liquid compositions of the present invention, such as a structurant, or a compound that also provides another function, such as a thickener or a surfactant (as described herein elsewhere).

Any suitable organic and inorganic suspending aids typically used as gelling, thickening or suspending agents in cleaning compositions and other detergent or cosmetic compositions may be used herein. Indeed, suitable organic suspending aids include polysaccharide polymers. In addition or as an alternative, polycarboxylate polymer thickeners may be used herein. Also, in addition or as an alternative of the above, layered silicate platelets e.g.: Hectorite, bentonite or montmorillonites can also be used. Suitable commercially available layered silicates are Laponite RD® or Optigel CL® available from Rockwood Additives.

Suitable polycarboxylate polymer thickeners include (preferably lightly) crosslinked polyacrylate. A particularly suitable polycarboxylate polymer thickeners is Carbopol commercially available from Lubrizol under the trade name Carbopol 674®.

Suitable polysaccharide polymers for use herein include substituted cellulose materials like carboxymethylcellulose, ethyl cellulose, hydroxyethyl cellulose, hydroxypropyl cellulose, hydroxymethyl cellulose; micro fibril cellulose (MFC) such as described in US 2008/0108714 (CP Kelco) or US2010/0210501 (P&G); succinoglycan and naturally occurring polysaccharide polymers like Xanthan gum, gellan gum, guar gum, locust bean gum, tragacanth gum, succinoglucan gum, or derivatives thereof, or mixtures thereof. Xanthan gum is commercially available from Kelco under the tradename Kelzan T.

Preferably the suspending aid herein is Xanthan gum. In an alternative embodiment, the suspending aid herein is a polycarboxylate polymer thickeners preferably a (preferably lightly) crosslinked polyacrylate. In a highly preferred embodiment herein, the liquid compositions comprise a combination of a polysaccharide polymer or a mixture thereof, preferably Xanthan gum, with a polycarboxylate polymer or a mixture thereof, preferably a crosslinked polyacrylate.

As a preferred example, Xanthan gum is preferably present at levels between 0.1% to 5%, more preferably 0.5% to 2%, even more preferably 0.8% to 1.2%, by weight of the total composition.

Organic Solvent

As an optional but highly preferred ingredient the composition herein comprises an organic solvents or mixtures thereof.

The compositions herein comprise from 0% to 30%, more preferably about 1.0% to about 20% and most preferably, about 2% to about 15% by weight of the total composition of an organic solvent or a mixture thereof.

Suitable solvents can be selected from the group consisting of: aliphatic alcohols, ethers and diethers having from about 4 to about 14 carbon atoms, preferably from about 6 to about 12 carbon atoms, and more preferably from about 8 to about 10 carbon atoms; glycols or alkoxylated glycols; glycol ethers; alkoxylated aromatic alcohols; aromatic alcohols; terpenes; and mixtures thereof. Aliphatic alcohols and glycol ether solvents are most preferred. Aliphatic alcohols, of the formula R—OH wherein R is a linear or branched, saturated or unsaturated alkyl group of from about 1 to about 20 carbon atoms, preferably from about 2 to about 15 and more preferably from about 5 to about 12, are suitable solvents. Suitable aliphatic alcohols are methanol, ethanol, propanol, isopropanol or mixtures thereof. Among aliphatic alcohols, ethanol and isopropanol are most preferred because of their high vapour pressure and tendency to leave no residue.

Suitable glycols to be used herein are according to the formula HO—$CR_1R_2$—OH wherein R1 and R2 are independently H or a $C_2$-$C_{10}$ saturated or unsaturated aliphatic hydrocarbon chain and/or cyclic. Suitable glycols to be used herein are dodecaneglycol and/or propanediol.

In one preferred embodiment, at least one glycol ether solvent is incorporated in the compositions of the present invention. Particularly preferred glycol ethers have a terminal $C_3$-$C_6$ hydrocarbon attached to from one to three ethylene glycol or propylene glycol moieties to provide the appropriate degree of hydrophobicity and, preferably, surface activity. Examples of commercially available solvents based on ethylene glycol chemistry include mono-ethylene glycol n-hexyl ether (Hexyl Cellosolve®) available from Dow Chemical. Examples of commercially available solvents based on propylene glycol chemistry include the di-, and tri-propylene glycol derivatives of propyl and butyl alcohol, which are available from Arco under the trade names Arcosolv® and Dowanol®.

In the context of the present invention, preferred solvents are selected from the group consisting of mono-propylene glycol mono-propyl ether, di-propylene glycol mono-propyl ether, mono-propylene glycol mono-butyl ether, di-propylene glycol mono-propyl ether, di-propylene glycol mono-butyl ether; tri-propylene glycol mono-butyl ether; ethylene glycol mono-butyl ether; di-ethylene glycol mono-butyl ether, ethylene glycol mono-hexyl ether and di-ethylene glycol mono-hexyl ether, and mixtures thereof. "Butyl" includes normal butyl, isobutyl and tertiary butyl groups. Mono-propylene glycol and mono-propylene glycol mono-butyl ether are the most preferred cleaning solvent and are available under the tradenames Dowanol DPnP® and Dowanol DPnB®. Di-propylene glycol mono-t-butyl ether is commercially available from Arco Chemical under the tradename Arcosolv PTB®.

In a particularly preferred embodiment, the cleaning solvent is purified so as to minimize impurities. Such impurities include aldehydes, dimers, trimers, oligomers and other by-products. These have been found to deleteriously affect product odour, perfume solubility and end result. The inventors have also found that common commercial solvents, which contain low levels of aldehydes, can cause irreversible and irreparable yellowing of certain surfaces. By purifying the cleaning solvents so as to minimize or eliminate such impurities, surface damage is attenuated or eliminated.

Though not preferred, terpenes can be used in the present invention. Suitable terpenes to be used herein monocyclic terpenes, dicyclic terpenes and/or acyclic terpenes. Suitable terpenes are: D-limonene; pinene; pine oil; terpinene; terpene derivatives as menthol, terpineol, geraniol, thymol; and the citronella or citronellol types of ingredients.

Suitable alkoxylated aromatic alcohols to be used herein are according to the formula R-$(A)_n$-OH wherein R is an alkyl substituted or non-alkyl substituted aryl group of from about 1 to about 20 carbon atoms, preferably from about 2 to about 15 and more preferably from about 2 to about 10, wherein A is an alkoxy group preferably butoxy, propoxy and/or ethoxy, and n is an integer of from about 1 to about 5, preferably about 1 to about 2. Suitable alkoxylated aromatic alcohols are benzoxyethanol and/or benzoxypropanol.

Suitable aromatic alcohols to be used herein are according to the formula R—OH wherein R is an alkyl substituted or non-alkyl substituted aryl group of from about 1 to about 20 carbon atoms, preferably from about 1 to about 15 and more preferably from about 1 to about 10. For example a suitable aromatic alcohol to be used herein is benzyl alcohol.

Surfactants

The compositions herein may comprise nonionic, anionic, zwitterionic, amphoteric, cationic surfactants or mixtures thereof. Suitable surfactants are those selected from the group consisting of nonionic, anionic, zwitterionic, cationic and amphoteric surfactants, having hydrophobic chains containing from 8 to 20 carbon atoms. Examples of suitable surfactants are described in McCutcheon's Vol. 1: Emulsifiers and Detergents, North American Ed., McCutcheon Division, MC Publishing Co., 2002.

Preferably, the composition herein comprises from 0.01% to 50%, more preferably from 0.5% to 40%, and most preferably from 1% to 36% by weight of the total composition of a surfactant or a mixture thereof.

Non-limiting examples of suitable non-ionic surfactants include alcohol alkoxylates, alkyl polysaccharides, amine oxides, block copolymers of ethylene oxide and propylene oxide, fluoro surfactants and silicon based surfactants. Non-ionic surfactant, when present as co-surfactant, is comprised in a typical amount of from 0.01% to 15%, preferably 0.1% to 12%, more preferably from 0.5% to 10% by weight of the liquid detergent composition. When present as main surfactant, it is comprised in a typical amount of from 0.8% to 40%, preferably 1% to 38%, more preferably 2% to 35% by weight of the total composition.

A preferred class of non-ionic surfactants suitable for the present invention is alkyl ethoxylates. The alkyl ethoxylates of the present invention are either linear or branched, primary or secondary, and contain from 8 carbon atoms to 22 carbon atoms in the hydrophobic tail, and from 1 ethylene oxide units to 25 ethylene oxide units in the hydrophilic head group. Examples of alkyl ethoxylates include Neodol 91-6®, Neodol 91-8® supplied by the Shell Corporation (P.O. Box 2463, 1 Shell Plaza, Houston, Tex.), and Alfonic 810-60® supplied by Condea Corporation, (900 Threadneedle P.O. Box 19029, Houston, Tex.). More preferred alkyl ethoxylates comprise from 9 to 15 carbon atoms in the hydrophobic tail, and from 4 to 12 oxide units in the hydrophilic head group. A most preferred alkyl ethoxylate is $C_{9-11}$ $EO_5$, available from the Shell Chemical Company under the tradename Neodol 91-5®. Non-ionic ethoxylates can also be derived from branched alcohols. For example, alcohols can be made from branched olefin feedstocks such as propylene or butylene. In a preferred embodiment, the branched alcohol is either a 2-propyl-1-heptyl alcohol or 2-butyl-1-octyl alcohol. A desirable branched alcohol ethoxylate is 2-propyl-1-heptyl E07/A07, manufactured and sold by BASF Corporation under the tradename Lutensol XP 79/XL 79®.

Another preferred class of non-ionic surfactant suitable for the present invention is amine oxide, especially coco dimethyl amine oxide or coco amido propyl dimethyl amine oxide. Amine oxide may have a linear or mid-branched alkyl moiety. Typical linear amine oxides include water-soluble amine oxides of formula $R^1$—$N(R^2)(R^3)$→(O) wherein $R^1$ is a $C_{8-18}$ alkyl moiety; $R^2$ and $R^3$ are independently selected from the group consisting of $C_{1-3}$ alkyl groups and $C_{1-3}$ hydroxyalkyl groups and preferably include methyl, ethyl, propyl, isopropyl, 2-hydroxethyl, 2-hydroxypropyl and 3-hydroxypropyl. The linear amine oxide surfactants in particular may include linear $C_{10}$-$C_{18}$ alkyl dimethyl amine oxides and linear $C_8$-$C_{12}$ alkoxy ethyl dihydroxy ethyl amine oxides. Preferred amine oxides include linear $C_{10}$, linear $C_{10}$-$C_{12}$, and linear $C_{12}$-$C_{14}$ alkyl dimethyl amine oxides. As used herein "mid-branched" means that the amine oxide has one alkyl moiety having $n_1$ carbon atoms with one alkyl branch on the alkyl moiety having $n_2$ carbon atoms. The alkyl branch is located on the a carbon from the nitrogen on the alkyl moiety. This type of branching for the amine oxide is also known in the art as an internal amine oxide. The total sum of $n_1$ and $n_2$ is from 10 to 24 carbon atoms, preferably from 12 to 20, and more preferably from 10 to 16. The number of carbon atoms for the one alkyl moiety ($n_1$) should be approximately the same number of carbon atoms as the one alkyl branch ($n_2$) such that the one alkyl moiety and the one alkyl branch are symmetric. As used herein "symmetric" means that $|n_1-n_2|$ is less than or equal to 5, preferably 4, most preferably from 0 to 4 carbon atoms in at least 50 wt %, more preferably at least 75 wt % to 100 wt % of the mid-branched amine oxides for use herein.

The amine oxide further comprises two moieties, independently selected from a $C_{1-3}$ alkyl, a $C_{1-3}$ hydroxyalkyl group, or a polyethylene oxide group containing an average of from about 1 to about 3 ethylene oxide groups. Preferably the two moieties are selected from a $C_{1-3}$ alkyl, more preferably both are selected as a $C_1$ alkyl.

Another class of non-ionic surfactant suitable for the present invention is alkyl polysaccharides. Such surfactants are disclosed in U.S. Pat. Nos. 4,565,647, 5,776,872, 5,883,062, and 5,906,973. Among alkyl polysaccharides, alkyl polyglycosides comprising five and/or six carbon sugar rings are preferred, those comprising six carbon sugar rings are more preferred, and those wherein the six carbon sugar ring is derived from glucose, i.e., alkyl polyglucosides ("APG"), are most preferred. The alkyl substituent in the APG chain length is preferably a saturated or unsaturated alkyl moiety containing from 8 to 16 carbon atoms, with an average chain length of 10 carbon atoms. $C_8$-$C_{16}$ alkyl polyglucosides are commercially available from several suppliers (e.g., Simusol® surfactants from Seppic Corporation, 75 Quai d'Orsay, 75321 Paris, Cedex 7, France, and Glucopon 220®, Glucopon 225®, Glucopon 425®, Plantaren 2000 N®, and Plantaren 2000 N UP®, from Cognis Corporation, Postfach 13 01 64, D 40551, Dusseldorf, Germany). Also suitable are alkylglycerol ethers and sorbitan esters.

Another class of non-ionic surfactant suitable for the present invention is fatty acid amide surfactants comprising an alkyl group containing from 7 to 21, preferably from 9 to 17, carbon atoms. Preferred amides are $C_8$-$C_{20}$ ammonia amides, monoethanolamides, diethanolamides, and isopropanolamides.

Other non-ionic surfactants that can be used include those derived from natural sources such as sugars and include $C_8$-$C_{16}$ N-alkyl glucose amide surfactants.

Alternative non-ionic detergent surfactants for use herein are alkoxylated alcohols generally comprising from 8 to 16 carbon atoms in the hydrophobic alkyl chain of the alcohol. Typical alkoxylation groups are propoxy groups or ethoxy groups in combination with propoxy groups, yielding alkyl ethoxy propoxylates. Such compounds are commercially available under the tradename Antarox® available from Rhodia (40 Rue de la Haie-Coq F-93306, Aubervilliers Cédex, France) and under the tradename Nonidet® available from Shell Chemical.

The condensation products of ethylene oxide with a hydrophobic base formed by the condensation of propylene oxide with propylene glycol are also suitable for use herein. The hydrophobic portion of these compounds will preferably have a molecular weight of from 1500 to 1800 and will exhibit water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to 40 moles of ethylene oxide. Examples of compounds of this type include certain of the commercially available Pluronic® surfactants, marketed by BASF. Chemically, such surfactants have the structure $(EO)_x(PO)_y(EO)_z$ or $(PO)_x(EO)_y(PO)_z$ wherein x, y, and z are from 1 to 100, preferably 3 to 50. Pluronic® surfactants known to be good wetting surfactants are more preferred. A description of the Pluronic® surfactants, and properties thereof, including wetting properties, can be found in the brochure entitled "BASF Performance Chemicals Plutonic® & Tetronic® Surfactants", available from BASF.

Other suitable though not preferred non-ionic surfactants include the polyethylene oxide condensates of alkyl phenols, e.g., the condensation products of alkyl phenols having an alkyl group containing from 6 to 12 carbon atoms in either a straight chain or branched chain configuration, with ethylene oxide, the said ethylene oxide being present in amounts equal to 5 to 25 moles of ethylene oxide per mole of alkyl phenol. The alkyl substituent in such compounds can be derived from oligomerized propylene, diisobutylene, or from other sources of iso-octane n-octane, iso-nonane or n-nonane.

Suitable anionic surfactants for use herein are all those commonly known by those skilled in the art. The anionic surfactants for use herein include alkyl sulphonates, alkyl aryl sulphonates, alkyl sulphates, alkyl alkoxylated sulphate surfactants, $C_6$-$C_{20}$ alkyl alkoxylated linear or branched diphenyl oxide disulphonates, or mixtures thereof.

When present in the composition anionic surfactant can be incorporated in the compositions herein in amounts ranging from 0.01% to 50%, preferably 0.5% to 40%, more preferably 2% to 35%.

Suitable sulphate surfactants for use in the compositions herein include water-soluble salts or acids of $C_{10}$-$C_{14}$ alkyl or hydroxyalkyl, sulphate and/or ether sulfate. Suitable counterions include hydrogen, alkali metal cation or ammonium or substituted ammonium, but preferably sodium. Where the hydrocarbyl chain is branched, it preferably comprises $C_{1-4}$ alkyl branching units. The average percentage branching of the sulphate surfactant is preferably greater than 30%, more preferably from 35% to 80% and most preferably from 40% to 60% of the total hydrocarbyl chains.

The sulphate surfactants may be selected from $C_8$-$C_{20}$ primary, branched-chain and random alkyl sulphates (AS); $C_{10}$-$C_{18}$ secondary (2,3) alkyl sulphates; $C_{10}$-$C_{18}$ alkyl alkoxy sulphates ($AE_xS$) wherein preferably x is from 1-30; $C_{10}$-$C_{18}$ alkyl alkoxy carboxylates preferably comprising 1-5 ethoxy units; mid-chain branched alkyl sulphates as discussed in U.S. Pat. No. 6,020,303 and U.S. Pat. No. 6,060,443; mid-chain branched alkyl alkoxy sulphates as discussed in U.S. Pat. No. 6,008,181 and U.S. Pat. No. 6,020,303.

Suitable alkyl alkoxylated sulphate surfactants for use herein are according to the formula $RO(A)_mSO_3M$ wherein R is an unsubstituted $C_6$-$C_{20}$ alkyl or hydroxyalkyl group having a $C_6$-$C_{20}$ alkyl component, preferably a $C_8$-$C_{20}$ alkyl or hydroxyalkyl, more preferably $C_{10}$-$C_{18}$ alkyl or hydroxyalkyl, A is an ethoxy or propoxy unit, m is greater than zero, typically between 0.5 and 6, more preferably between 0.5 and 5, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperidinium and cations derived from alkanolamines such as ethylamine, diethylamine, triethylamine, mixtures thereof, and the like. Exemplary surfactants are $C_{12}$-$C_{18}$ alkyl polyethoxylate (1.0) sulfate ($C_{12}$-$C_{18}E(1.0)SM$), $C_{12}$-$C_{18}$ alkyl polyethoxylate (2.25) sulfate ($C_{12}$-$C_{18}E(2.25)SM$), $C_{12}$-$C_{18}$ alkyl polyethoxylate (3.0) sulfate ($C_{12}$-$C_{18}E(3.0)SM$), $C_{12}$-$C_{18}$ alkyl polyethoxylate (4.0) sulfate ($C_{12}$-$C_{18}E$ (4.0)SM), wherein M is conveniently selected from sodium and potassium.

Suitable alkyl sulphonates for use herein include water-soluble salts or acids of the formula $RSO_3M$ wherein R is a $C_6$-$C_{20}$ linear or branched, saturated or unsaturated alkyl group, preferably a $C_8$-$C_{18}$ alkyl group and more preferably a $C_{10}$-$C_{16}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperidinium cations and quaternary ammonium cations derived from alkylamines such as ethylamine, diethylamine, triethylamine, and mixtures thereof, and the like). Particularly suitable liner alkyl sulphonates include $C_{12}$-$C_{16}$ paraffin sulphonate like Hostapur® SAS commercially available from Hoechst.

Suitable alkyl aryl sulphonates for use herein include water-soluble salts or acids of the formula $RSO_3M$ wherein R is an aryl, preferably a benzyl, substituted by a $C_6$-$C_{20}$ linear or branched saturated or unsaturated alkyl group, preferably a $C_8$-$C_{18}$ alkyl group and more preferably a $C_{10}$-$C_{16}$ alkyl group, and M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperidinium cations and quaternary ammonium cations derived from alkylamines such as ethylamine, diethylamine, triethylamine, and mixtures thereof, and the like). An example of commercially available alkyl aryl sulphonate is Lauryl aryl sulphonate from Su.Ma. Particularly preferred alkyl aryl sulphonates are alkyl benzene sulphonates commercially available under trade name Nansa® available from Albright&Wilson. Suitable $C_6$-$C_{20}$ alkyl alkoxylated linear or branched diphenyl oxide disulphonate surfactants for use herein are according to the following formula:

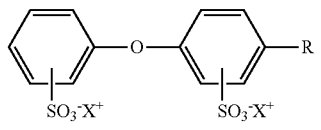

wherein R is a $C_6$-$C_{20}$ linear or branched, saturated or unsaturated alkyl group, preferably a $C_{12}$-$C_{18}$ alkyl group and more preferably a $C_{14}$-$C_{16}$ alkyl group, and X+ is H or a cation, e.g., an alkali metal cation (e.g., sodium, potassium, lithium, calcium, magnesium and the like). Particularly suitable $C_6$-$C_{20}$ alkyl alkoxylated linear or branched diphenyl oxide disulphonate surfactants to be used herein are the $C_{12}$ branched di phenyl oxide disulphonic acid and $C_{16}$ linear di phenyl oxide disulphonate sodium salt respectively commercially available by DOW under the trade name Dowfax 2A1® and Dowfax 8390®.

Other anionic surfactants useful herein include salts (including, for example, sodium, potassium, ammonium, and substituted ammonium salts such as mono-, di- and triethanolamine salts) of soap, $C_8$-$C_{24}$ olefinsulfonates, sulphonated polycarboxylic acids prepared by sulphonation of the pyrolyzed product of alkaline earth metal citrates, e.g., as described in British patent specification No. 1,082,179, $C_8$-$C_{24}$ alkylpolyglycolethersulfates (containing up to 10 moles of ethylene oxide); alkyl ester sulfonates such as $C_{14}$-$C_{16}$ methyl ester sulfonates; acyl glycerol sulfonates, fatty oleyl glycerol sulfates, alkyl phenol ethylene oxide ether sulfates, alkyl phosphates, isethionates such as the acyl isethionates, N-acyl taurates, alkyl succinamates and sulfosuccinates, monoesters of sulfosuccinate (especially saturated and unsaturated $C_{12}$-$C_{18}$ monoesters) diesters of sulfosuccinate (especially saturated and unsaturated $C_6$-$C_{14}$ diesters), acyl sarcosinates, sulfates of alkylpolysaccharides such as the sulfates of alkylpolyglucoside (the nonionic nonsulfated compounds being described below), alkyl polyethoxy carboxylates such as those of the formula $RO(CH_2CH_2O)_kCH_2COO^-M^+$wherein R is a $C_8$-$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Zwitterionic surfactants represent another class of preferred surfactants within the context of the present invention. When present in the composition, zwitteronic surfactants may be comprised at levels from 0.01% to 20%, preferably from 0.2% to 15%, more preferably 0.5% to 12%. Zwitterionic surfactants contain both cationic and anionic groups on the same molecule over a wide pH range. The typical cationic group is a quaternary ammonium group, although other positively charged groups like sulfonium and phosphonium groups can also be used. The typical anionic groups are carboxylates and sulfonates, preferably sulfonates, although other groups like sulfates, phosphates and the like, can be used. Some common examples of these detergents are described in the patent literature: U.S. Pat. Nos. 2,082,275, 2,702,279 and 2,255,082.

Suitable zwitteronic surfactants include betaines such alkyl betaines, alkylamidobetaine, amidazoliniumbetaine, sulfobetaine (INCI Sultaines) as well as the Phosphobetaine and preferably meets formula I:

$$R^1—[CO—X(CH_2)_n]_x—N^+(R^2)(R^3)—(CH_2)_m—[CH(OH)—CH_2]_y—Y—\text{(I) wherein}$$

$R^1$ is a saturated or unsaturated $C_{6-22}$ alkyl residue, preferably $C_{8-18}$ alkyl residue, in particular a saturated $C_{10-16}$ alkyl residue, for example a saturated $C_{12-14}$ alkyl residue;

X is NH, $NR^4$ with $C_{14}$ Alkyl residue $R^4$, O or S, n a number from 1 to 10, preferably 2 to 5, in particular 3, x 0 or 1, preferably 1, $R^2$, $R^3$ are independently a $C_{1-4}$ alkyl residue, potentially hydroxy substituted such as a hydroxyethyl, preferably a methyl.

m a number from 1 to 4, in particular 1, 2 or 3, y 0 or 1 and

Y is COO, SO3, $OPO(OR^5)O$ or $P(O)(OR^5)O$, whereby $R^5$ is a hydrogen atom H or a $C_{1-4}$ alkyl residue.

Preferred betaines are the alkyl betaines of the formula (Ia), the alkyl amido betaine of the formula (Ib), the sulfo betaines of the formula (Ic) and the amido sulfobetaine of the formula (Id);

$$R^1—N^+(CH_3)_2—CH_2COO^- \quad \text{(Ia)}$$

$$R^1—CO—NH(CH_2)_3—N^+(CH_3)_2—CH_2COO^- \quad \text{(Ib)}$$

$$R^1—N^+(CH_3)_2—CH_2CH(OH)CH_2SO_3— \quad \text{(IC)}$$

$$R^1—CO—NH—(CH_2)_3—N^+(CH_3)_2—CH_2CH(OH)CH_2SO_3— \quad \text{(Id)}$$

in which $R^1$ has the same meaning as in formula I. Particularly preferred betaines are the Carbobetaine [wherein $Y^-$=$COO^-$], in particular the carbobetaine of the formula (Ia) and (Ib), more preferred are the alkylamidobetaine of the formula (Ib).

Examples of suitable betaines and sulfobetaine are the following: almondamidopropyl betaine, Apricotamidopropyl betaine, avocadoamidopropyl betaine, babassuamidopropyl betaine, behen amidopropyl betaine, behenyl betaine, canolamidopropyl betaine, capryl/capramidopropyl betaine, carnitine, cetylbetaine, cocamidoethyl betaine, cocamidopropyl betaine, cocamidopropyl hydroxysultaine, cocobetaine, cocohydroxysultaine, coco/oleamidopropyl betaine, coco sultaine, decyl betaine, dihydroxyethyloleylglycinate, dihydroxyethylstearylglycinate, dihydroxyethyl tallow glycinate, dimethiconepropyl pg-betaine, erucamidopropyl hydroxysultaine, hydrogenated tallow betaine, isostearamidopropyl betaine, lauramidopropyl betaine, lauryl betaine, lauryl hydroxysultaine, lauryl sultaine, milkamidopropyl betaine, minkamidopropyl betaine, myristamidopropyl betaine, myristyl betaine, oleamidopropyl betaine, oleamidopropyl hydroxysultaine, oleylbetaine, olivamidopropyl betaine, palmamidopropyl betaine, palmitamidopropyl betaine, palmitoyl carnitine, palmkernelamidopropyl betaine, polytetrafluoroethylene acetoxypropyl betaine, ricinole amidopropyl betaine, sesamidopropyl betaine, soyamidopropyl betaine, stearamidopropyl betaine, stearyl betaine, tallow amidopropyl betaine, tallowamidopropylhydroxysultaine, tallow betaine, tallowedihydroxyethyl betaine, undecylenamidopropyl betaine and wheat germ amidopropyl betaine. Preferred betaine is for example cocamidopropyl betaine.

A specific example of a zwitterionic surfactant is 3-(N-dodecyl-N,N-dimethyl)-2-hydroxypropane-1-sulfonate (Lauryl hydroxyl sultaine) available from the McIntyre Company (24601 Governors Highway, University Park, Ill. 60466, USA) under the tradename Mackam LHS®. Another specific zwitterionic surfactant is $C_{12-14}$ acylamidopropylene (hydroxypropylene) sulfobetaine that is available from McIntyre under the tradename Mackam 50-SB®. Other very useful zwitterionic surfactants include hydrocarbyl, e.g., fatty alkylene betaines. A highly preferred zwitterionic surfactant is Empigen BB®, a coco dimethyl betaine produced by Albright & Wilson. Another equally preferred zwitterionic surfactant is Mackam 35HP®, a coco amido propyl betaine produced by McIntyre.

Another class of preferred surfactants comprises the group consisting of amphoteric surfactants. One suitable amphoteric surfactant is a $C_8$-$C_{16}$ amido alkylene glycinate surfactant ('ampho glycinate'). Another suitable amphoteric surfactant is a $C_8$-$C_{16}$ amido alkylene propionate surfactant ('ampho propionate'). Other suitable, amphoteric surfactants are represented by surfactants such as dodecylbeta-alanine, N-alkyltaurines such as the one prepared by reacting dodecylamine with sodium isethionate according to the teaching of U.S. Pat. No. 2,658,072, N-higher alkylaspartic acids such as those produced according to the teaching of U.S. Pat. No. 2,438,091, and the products sold under the trade name "Miranol®", and described in U.S. Pat. No. 2,528,378.

Cationic surfactants, when present in the composition, are present in an effective amount, more preferably from 0.1% to 20%, by weight of the liquid detergent composition. Suitable cationic surfactants are quaternary ammonium surfactants. Suitable quaternary ammonium surfactants are selected from the group consisting of mono $C_6$-$C_{16}$, preferably $C_6$-$C_{10}$ N-alkyl or alkenyl ammonium surfactants, wherein the remaining N positions are substituted by methyl, hydroxyethyl or hydroxypropyl groups. Another preferred cationic surfactant is $C_6$-$C_{18}$ alkyl or alkenyl ester of a quaternary ammonium alcohol, such as quaternary chlorine esters.

Chelating Agents

One class of optional compounds for use herein includes chelating agents or mixtures thereof. Chelating agents can be incorporated in the compositions herein in amounts ranging from 0.0% to 10.0% by weight of the total composition, preferably 0.01% to 5.0%.

Suitable phosphonate chelating agents for use herein may include alkali metal ethane 1-hydroxy diphosphonates (HEDP), alkylene poly (alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agents to be used herein are diethylene triamine penta methylene phosphonate (DTPMP) and ethane 1-hydroxy diphosphonate (HEDP). Such phosphonate chelating agents are commercially available from Monsanto under the trade name DEQUEST®.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987, to Hartman and Perkins. Ethylenediamine N,N'-disuccinic acids is, for instance, commercially available under the tradename ssEDDS® from Palmer Research Laboratories.

Suitable amino carboxylates for use herein include ethylene diamine tetra acetates, diethylene triamine pentaacetates, diethylene triamine pentaacetate (DTPA), N-hydroxyethylethylenediamine triacetates, nitrilotri-acetates, ethylenediamine tetrapropionates, triethylenetetraaminehexa-acetates, ethanol-diglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FS® and methyl glycine di-acetic acid (MGDA).

Further carboxylate chelating agents for use herein include salicylic acid, aspartic acid, glutamic acid, glycine, malonic acid or mixtures thereof.

Radical Scavenger

The compositions of the present invention may further comprise a radical scavenger or a mixture thereof.

Suitable radical scavengers for use herein include the well-known substituted mono and dihydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butyl-hydroxy anysole, benzoic acid, toluic acid, catechol, t-butyl catechol, benzylamine, 1,1,3-tris(2-methyl-4-hydroxy-5-t-butylphenyl) butane, n-propyl-gallate or mixtures thereof and highly preferred is di-tert-butyl hydroxy toluene. Such radical scavengers like N-propyl-gallate may be commercially available from Nipa Laboratories under the trade name Nipanox S1®.

Radical scavengers, when used, may be typically present herein in amounts up to 10% by weight of the total composition and preferably from 0.001% to 0.5% by weight. The presence of radical scavengers may contribute to the chemical stability of the compositions of the present invention.

Perfume

Suitable perfume compounds and compositions for use herein are for example those described in EP-A-0 957 156 under the paragraph entitled "Perfume", on page 13. The compositions herein may comprise a perfume ingredient, or mixtures thereof, in amounts up to 5.0% by weight of the total composition, preferably in amounts of 0.1% to 1.5%.

Dye

The liquid compositions according to the present invention may be coloured. Accordingly, they may comprise a dye or a mixture thereof.

Preservatives

The liquid compositions according to present invention may comprise preservatives to prevent bio-growth potentially coming from the natural abrasive.

Delivery Form of the Compositions

The compositions herein may be packaged in a variety of suitable packaging known to those skilled in the art, such as plastic bottles for pouring liquid compositions, squeeze bottles or bottles equipped with a trigger sprayer for spraying liquid compositions. Alternatively, the paste-like compositions according to the present invention may by packaged in a tube.

In an alternative embodiment herein, the liquid composition herein is impregnated onto a substrate, preferably the substrate is in the form of a flexible, thin sheet or a block of material, such as a sponge.

Suitable substrates are woven or non-woven sheets, cellulosic material based sheets, sponge or foam with open cell structures e.g.: polyurethane foams, cellulosic foam, melamine foam, etc.

The Process of Cleaning a Surface

The present invention encompasses a process of cleaning a surface with a liquid composition according to the present invention. Suitable surfaces herein are described herein above under the heading "The liquid cleaning composition".

In a preferred embodiment said surface is contacted with the composition according to the present invention, preferably wherein said composition is applied onto said surface.

In another preferred embodiment, the process herein comprises the steps of dispensing (e.g., by spraying, pouring, squeezing) the liquid composition according to the present invention from a container containing said liquid composition and thereafter cleaning said surface.

The composition herein may be in its neat form or in its diluted form.

By "in its neat form", it is to be understood that said liquid composition is applied directly onto the surface to be treated without undergoing any dilution, i.e., the liquid composition herein is applied onto the surface as described herein.

By "diluted form", it is meant herein that said liquid composition is diluted by the user typically with water. The liquid composition is diluted prior to use to a typical dilution level of up to 10 times its weight of water. A usually recommended dilution level is a 10% dilution of the composition in water.

The composition herein may be applied using an appropriate implement, such as a mop, paper towel, brush or a cloth, soaked in the diluted or neat composition herein. Furthermore, once applied onto said surface said composition may be agitated over said surface using an appropriate implement. Indeed, said surface may be wiped using a mop, paper towel, brush or a cloth.

The process herein may additionally contain a rinsing step, preferably after the application of said composition. By "rinsing", it is meant herein contacting the surface cleaned with the process according to the present invention with substantial quantities of appropriate solvent, typically water, directly after the step of applying the liquid composition herein onto said surface. By "substantial quantities", it is meant herein between 0.01 lt. and 1 lt. of water per $m^2$ of surface, more preferably between 0.1 lt. and 1 lt. of water per $m^2$ of surface.

Cleaning Effectiveness

Cleaning Effectiveness Test Method:

Ceramic tiles (typically glossy, white, ceramic 24 cm×4 cm) are covered with various homecare soils such as pure vegetable grease, greasy soap scum or neat kitchen dirt. Then the soiled tiles are cleaned using 4-5 ml of the composition of the present invention poured directly on a Spontex® cellulose sponge pre-wetted with water. The sponge is then mounted on a Wet Abrasion Scrub Tester Instrument (such as made by Sheen Instruments Ltd. Kingston, England) with the particle composition coated side facing the tile. The abrasion tester can be configured to supply pressure (e.g.:600 g), and move the sponge over the test surface with a set stroke length (e.g.:30 cm), at set speed (e.g.:37 strokes per minute). The ability of the composition to remove greasy soap scum is measured through the number of strokes needed to perfectly clean the surface, as determined by visual assessment. The lower the number of strokes, the higher the greasy soap scum cleaning ability of the composition.

Cleaning data below are achieved with 3-10% of coloured abrasive particles in cleaner. Abrasive cleaning particles used to generate the example cleaning data were prepared by colouring walnut shell, olive stone or wood particles.

| Product/Soil type | |
|---|---|
| | Pure vegetable grease* |
| Dish Cleaner | 34 strokes to clean |
| Dish cleaner with 3% blue coloured wood abrasive particles (166-375 μm) | 8 strokes to clean |
| | Greasy soap scum** |
| Bathroom Cleaner (with 1.8% of anionic surfactant, pH 3.) | >45 strokes to clean |
| Bathroom Cleaner with 3% uncolored Olive stone particles (size 270-230 μm, 81 shore D hardness) | 23.8 strokes to clean |
| Bathroom Cleaner with 3% green Olive stone particles (size 270-230 μm, 81 shore D hardness) | 24.3 strokes to clean |
| Bathroom Cleaner with 3% blue Olive stone particles (size 270-230 μm, 81 shore D hardness) | 26 strokes to clean |
| All Purpose Cleaner (with 3.5% nonionic surfactant, pH 9) | >70 strokes to clean |
| All Purpose Cleaner with 3% uncolored Olive stone particles (size 270-230 μm, 81 shore D hardness) | 31 strokes to clean |
| All Purpose Cleaner with 3% green Olive stone particles (size 270-230 μm, 81 shore D hardness) | 28.8 strokes to clean |
| All Purpose Cleaner with 3% blue Olive stone particles (size 270-230 μm, 81 shore D hardness) | 32.8 strokes to clean |
| Bathroom Cleaner (with 1.8% of anionic surfactant, pH 3.) | >45 strokes to clean |
| Bathroom Cleaner with 3% white walnut shell particles (Equivalent Circle Diameter 196 μm, Circularity 0.57, 75 shore D hardness) | 31 strokes to clean |
| Bathroom Cleaner with 6% white walnut shell particles (Equivalent Circle Diameter 196 μm, Circularity 0.57, 75 shore D hardness) | 26 strokes to clean |
| Bathroom Cleaner with 9% white walnut shell particles (Equivalent Circle Diameter 196 μm, Circularity 0.57, 75 shore D hardness) | 21 strokes to clean |
| All Purpose Cleaner (with 3.5% nonionic surfactant, pH 9) | >70 strokes to clean |
| All Purpose Cleaner with 3% white walnut shell particles (Equivalent Circle Diameter 196 μm, Circularity 0.6, 75 shore D hardness) | 51 strokes to clean |
| All Purpose Cleaner with 4% white walnut shell particles (Equivalent Circle Diameter 196 μm, Circularity 0.6, 75 shore D hardness) | 37 strokes to clean |
| All Purpose Cleaner with 6% white walnut shell particles (Equivalent Circle Diameter 196 μm, Circularity 0.6, 75 shore D hardness) | 28 strokes to clean |

-continued

| Product/Soil type | |
|---|---|
| All Purpose Cleaner with 10% white walnut shell particles (Equivalent Circle Diameter 196 μm, Circularity 0.6, 75 shore D hardness) | 25 strokes to clean |

*0.6 g pure vegetable oil mix (peanut, sunflower and corn oil at equal proportions) spread on 24 cm x 7 cm white, glossy, enamel tiles using a paint roller to obtain a uniform layer on top of the tile. Tiles are baked in an oven at 145° C. for 2 hours and 10 minutes.
**0.3 g of typical greasy soap scum soils mainly based on calcium stearate and artificial body soils commercially available (applied to the tile via a sprayer). The soiled tiles are then dried in an oven at a temperature of 140° C. for 10-45 minutes, preferably 40 minutes and then aged between 2 and 12 hours at room temperature (around 20° C.) in a controlled environment humidity (60-85% RH, preferably 75% RH)

Examples

These following compositions were made comprising the coloured nut and stone particles. Examples 1-22 herein are met to exemplify the present invention but are not necessarily used to limit or otherwise define the scope of the present invention.

Hard surface cleaner Bathroom composition:

| % Weight | 1 | 2 | 3 |
|---|---|---|---|
| C9-C11 EO8 (Neodol 91-8 ®) | 3 | 2.5 | 3.5 |
| Alkyl Benzene sulfonate | | 1 | |
| C12-14-dimethyl Aminoxide | | 1 | |
| n-Butoxy Propoxy Propanol | | 2 | 2.5 |
| Hydrogene Peroxide | 3 | | |
| Hydrophobic ethoxylated polyurethane (Acusol 882 ®) | 1.5 | 1 | 0.8 |
| Lactic Acid | 3 | | 3.5 |
| Citric Acid | | 3 | 0.5 |
| Polysaccharide (Xanthan Gum, Keltrol CG-SFT ® Kelco) | 0.25 | 0.25 | 0.25 |
| Perfume | 0.35 | 0.35 | 0.35 |
| Coated Walnut shell particles with 10% coating mix (25% TiO2/75% Carnauba wax) | 1 | 1 | 1 |
| Water | Balance | Balance | Balance |

| % Weight | 4 | 5 | 6 |
|---|---|---|---|
| Chloridric acid | 2 | | |
| Linear C10 alkyl sulphate | 1.3 | 2 | 3 |
| n-Butoxy Propoxy Propanol | 2 | | 1.75 |
| Citric Acid | | 3 | 3 |
| PolyvinylPyrrolidone (Luviskol K60 ®) | 0.1 | 0.1 | 0.1 |
| NaOH | | 0.2 | 0.2 |
| Perfume | 0.4 | 0.4 | 0.4 |
| Polysaccharide (Xanthan Gum Kelzan T ®, Kelco) | 0.3 | 0.35 | 0.35 |
| Coated Olive stone particles with 7% coating mix (25% TiO2/75% Carnauba wax) | 2 | 2 | 2 |
| Water | Balance | Balance | Balance |

Hand-dishwashing detergent compositions:

| % Weight | 7 | 8 | 9 | 10 | 11 | 12 |
|---|---|---|---|---|---|---|
| Alkyl Ethoxy Sulfate | 18 | 24 | 9 | — | 5 | 15.2 |
| Linear Alkylbenzene Sulfonate | — | — | 11 | — | 15 | — |
| Paraffin Sulfonate | — | — | — | — | — | — |
| Coco amido propyl Betaine | — | — | 6 | — | — | — |
| Ethoxylated alkyl alcohol | — | — | 2 | 33 | 1 | 4.7 |
| Dimehtyl coco alkyl Amine Oxide | 6 | 5.3 | 2 | 2 | — | 5.1 |
| Alkylpolyglucoside | — | — | — | — | 6 | — |
| Ethanol | — | 1.5 | 1 | 9 | 2 | 0.7 |
| Polypropyleneglycol | 0.8 | 0.7 | 0.5 | 0.3 | 0.2 | 0.25 |
| Citrate | 2.5 | — | — | — | — | — |
| NaCl | 0.5 | 1.25 | 0.25 | — | — | 0.5 |
| Sodium cumene sulfonate | — | — | — | 3 | 2 | — |
| Glutamic acid-N,N-diacetic acid (GLDA) | — | — | 0.6 | — | — | 0.7 |

-continued

| | | | | | | |
|---|---|---|---|---|---|---|
| Green Colored Olive stone with Diamine green B/sodium Sulphate | 5 | — | — | 3 | 2.5 | — |
| Yellow walnut shell particles colored with Direct yellow G, Direct yellow R/sodium sulphate | — | 3 | 5.5 | — | — | 2.5 |
| Cationic polymer (1) | 0.1 | — | — | 0.2 | — | 0.1 |
| Hydrogenated Castor Oil | — | 0.3 | 0.2 | — | — | — |
| MFC CP Kelko | 0.15 | — | — | 0.03 | 0.1 | 0.2 |
| Ethylene glycol diesterate | 0.4 | — | — | 0.8 | — | — |
| Opacifier (2) | — | — | — | = | — | — |
| Minors | | | | | | |
| pH | 9 | 9 | 7 | 6.5 | 6 | 9.2 |

General degreaser composition:

| % Weight | 13 | 14 |
|---|---|---|
| C9-C11 EO8 (Neodol 91-8 ®) | 3 | 3 |
| N-Butoxy Propoxy Propanol | 15 | 15 |
| Ethanol | 10 | 5 |
| Isopropanol | | 10 |
| Polysaccharide (Xanthan Gum-glyoxal modified Optixan-T) | 0.35 | 0.35 |
| Green Colored Olive stone with Diamine green B/sodium Sulphate | 1 | 1 |
| Water (+ minor e.g.; pH adjusted to alkaline pH) | Balance | Balance |

Scouring composition:

| % Weight | 15 | 16 | 17 |
|---|---|---|---|
| Sodium C13-16 prafin sulfonate | 2.5 | 2.5 | 2.5 |
| C12-14-EO7 (Lutensol AO7 ®) | 0.5 | 0.5 | 0.5 |
| Coconut Fatty Acid | 0.3 | 0.3 | 0.3 |
| Sodium Citrate | 3.3 | 3.3 | 3.3 |
| Sodium Carbonate | 3 | 3 | 3 |
| Orange terpenes | 2.1 | 2.1 | 2.1 |
| Benzyl Alcohol | 1.5 | 1.5 | |
| Polyacrylic acid 1.5Mw | 0.75 | 0.75 | 0.75 |
| Diatomaceous earth (Celite 499 ® median size 10 μm) | 25 | | |
| Calcium Carbonate (Merk 2066 ® median size 10 μm) | | 25 | |
| Blue pistachio shell colored with Congo blue 2 B/sodium sulphate/Zinc suphate | 5 | 5 | 5 |
| Water | Balance | Balance | Balance |

Liquid glass cleaner:

| % Weight | 18 | 19 |
|---|---|---|
| Butoxypropanol | 2 | 4 |
| Ethanol | 3 | 6 |
| C12-14 sodium sulphate | 0.24 | |
| NaOH/Citric acid | To pH 10 | |
| Citric Acid | | |
| Blue pistachio shell particle colored with Azo blue/Benzo blue 3B/sodium sulphate/iron sulphate | 0.5 | 0.5 |
| Water (+ minor) | Balance | Balance |

-continued

| Cleaning wipe (surface cleansing wipe): | | | |
|---|---|---|---|
| % Weight | 20 | 21 | 22 |
| C10 Amine Oxide | — | 0.02 | — |
| C12,14 Amine Oxide | 0.4 | — | — |
| Betaine (Rewoteric AM CAS 15 U) | — | — | 0.2 |
| C9,11 A5EO (Neodol E 91.5 ®) | — | 0.1 | — |
| C9,11 A8EO (Neodol E 91.8 ®) | — | — | 0.8 |
| C12,14 A5EO | 0.125 | — | — |
| 2-Ethyl Hexyl Sulphate | — | 0.05 | 0.6 |
| Silicone | 0.001 | 0.003 | 0.003 |
| EtOH | 9.4 | 8.0 | 9.5 |
| Propylene Glycol Butyl Ether | 0.55 | 1.2 | — |
| Geraniol | — | — | 0.1 |
| Citric acid | 1.5 | — | — |
| Lactic acid | — | | 1.5 |
| Perfume | 0.25 | 0.15 | 0.15 |
| Yellow pistachio shell particle colored with Titan yellow G G, Titan yellow Y/sodium sulphate | 5 | 3 | 3 |
| Nonwoven: Spunlace 100% viscose 50 gsm (lotion loading fact) | | | (x3.5) |
| Nonwoven: Airlaid walkisoft (70% cellulose, 12% Viscose, 18% binder) 80 gsm (lotion loading factor) | | (x3.5) | |
| Carded thermobonded (70% polypropylene, 30% rayon), 70 gsm (Lotion loading factor) | (x3.5) | | |

*Minors: dyes, perfumes, preservatives, hydrotropes, processing aids, stabilizers (1) Guar hydroxypropyl trimonium chloride (2) Acusol ™ OP301 ex. Rohm and Haas The above wipes lotion composition is loaded onto a water-insoluble substrate, being a patterned hydroentangled non-woven substrate having a basis weight of 56 gms comprising 70% polyester and 30% rayon approximately 6.5 inches wide by 7.5 inches long with a caliper of about 0.80 mm. Optionally, the substrate can be pre-coated with dimethicone (Dow Corning 200 Fluid 5 cst) using conventional substrate coating techniques. Lotion to wipe weight ratio of about 2:1 using conventional substrate coating techniques.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid cleaning composition comprising coloured cleaning particles as abrasives,wherein said coloured cleaning particles are selected from the group consisting of coloured nut shell particles, coloured stone particles, coloured particles derived from other plant parts, coloured wood particles and mixtures thereof, and wherein the liquid and the coloured cleaning particles have substantially same colour according to L*a*b* values based on CIELab colour measurement, wherein the difference between L*a*b* values of the liquid and the coloured abrasive particles, ΔL* and Δa* and Δb* values are equal or below about ±20.

2. A liquid cleaning composition comprising coloured cleaning particles as abrasives, wherein said coloured cleaning particles are selected from the group consisting of coloured nut shell particles, coloured stone particles, coloured particles derived from other plant parts, coloured wood particles and mixtures thereof, and wherein the liquid and the coloured cleaning particles have substantially different colour according to L*a*b* values based on CIELab colour measurement, the difference between L*a*b* values of the liquid and the coloured abrasive particles, ΔL*and/or Δa* and/or Δb* values are equal or above about ±30.

3. A liquid cleaning and/or cleansing composition according to claim 1, wherein the liquid and the coloured particles have same colours according to L*a*b* values based on CIELab colour measurement, wherein the difference between L*a*b* values of liquid and abrasive particles, ΔL* and Δa* and Δb* values are equal or below about ±10.

4. A liquid cleaning and/or cleansing composition according to claim 1, wherein the liquid and the coloured particles have substantially same colours according to L*a*b* values based on CIELab colour measurement, wherein the difference between L*a*b* values of liquid and abrasive particles, ΔL* and Δa* and Δb* values are equal or below about ±5.

5. A liquid cleaning and/or cleansing composition according to claim 2, wherein the liquid and the coloured particles have substantially different colours according to L*a*b* values based on CIELab colour measurement, wherein the difference between L*a*b* values of liquid and abrasive particles, ΔL* and/or Δa* and/or Δb* values are equal or above about ±40.

6. A liquid cleaning and/or cleansing composition according to claim 2, wherein the liquid and the coloured particles have different colours according to L*a*b* values based on CIELab colour measurement, wherein the difference between L*a*b* values of liquid and abrasive particles, ΔL* and/or Δa* and/or Δb* values are preferably equal or above about ±50.

7. A liquid cleaning and/or cleansing composition according to claim 1 or claim 2, wherein nut shell particles are selected from the group consisting of pistachio nut shell particles, almond shell particles, walnut shell particles and mixtures thereof.

8. A liquid cleaning and/or cleansing composition according to claim 1 or claim 2, wherein coloured particles derived from other plant parts are derived from rice, corn cob, palm biomass, bamboo, kenaf, apple seeds, apricot stone, peach stone olive stone and mixtures thereof.

9. A liquid cleaning and/or cleansing composition according to claim 1 or claim 2, wherein the colored particles are colored with direct dyes, wherein said direct dyes are selected from the group consisting of Azo, Benzo, Chicago, Columbia, Congo, Di or triamine, Paramine, Dianil, Mikado, Oxydiamine, Titan and Zambessi dyes and mixtures thereof.

10. A liquid cleaning and/or cleansing composition according to claim 1 or claim 2, wherein the direct dyes are fixed with salt selected from the group consisting of carbonate or bicarbonate salt, phosphate salt, borax salt, sulfate salt, zinc salt, chromium salt, iron salt, zirconium salt, aluminium salt, copper salt and mixture thereof.

11. A liquid cleaning and/or cleansing composition according to claim 1 or claim 2, wherein the colored particles are colored with basic dyes and tannic acid.

12. A liquid cleaning and/or cleansing composition according to claim 1 or claim 2, wherein the colored particles are colored with basic Janus dyes and sulfuric acid.

13. A liquid cleaning and/or cleansing composition according to claim 1 or claim 2, wherein the colored particles are colored with mordant dyes and metal oxides.

14. A liquid cleaning and/or cleansing composition according to claim 1 or claim 2, wherein the colored particles are colored with Vat dyes, wherein the Vat dyes are preferably derived from quinonic structure, anthraquinones or indigoids.

15. A liquid cleaning and/or cleansing composition according claim 1 or claim 2, furthercomprises a suspending aid, wherein said suspending aid is selected from the group consisting of polycarboxylate polymer thickeners, carboxymethylcellulose, ethyl cellulose, hydroxyethyl cellulose, hydroxypropyl cellulose, hydroxymethyl cellulose, micro fibril cellulose, succinoglycan and naturally occurring polysaccharide polymers like Xanthan gum, gellan gum, guar gum, locust bean gum, tragacanth gum, succinoglucan gum, or derivatives thereof, or mixtures thereof.

16. A liquid cleaning and/or cleansing composition according to claim 1 or claim 2, wherein said cleaning composition is loaded on a cleaning substrate, wherein the substrate is a paper or nonvowen towel or wipe or a sponge.

17. A process of cleaning and/or cleansing a surface with a liquid, cleaning and/or cleansing composition according to claim 1 or claim 2, wherein said surface is contacted with said composition, preferably wherein said composition is applied onto said surface.

18. A process according to claim 17, wherein said surface is an inanimate surface, preferably selected from the group consisting of household hard surfaces; dish surfaces; surfaces like leather or synthetic leather; and automotive vehicles surfaces.

* * * * *